US009050772B2

(12) United States Patent
Hidaka et al.

(10) Patent No.: US 9,050,772 B2
(45) Date of Patent: Jun. 9, 2015

(54) SHEET PROCESSING APPARATUS, IMAGE FORMING SYSTEM, AND SHEET-BUNDLE FOLD-ENHANCING METHOD

(71) Applicants: Makoto Hidaka, Tokyo (JP); Satoshi Saito, Kanagawa (JP); Shohichi Satoh, Kanagawa (JP); Mamoru Kambayashi, Tokyo (JP); Tomomichi Hoshino, Kanagawa (JP); Atsushi Kikuchi, Kanagawa (JP); Kiyoshi Hata, Tokyo (JP); Keisuke Sugiyama, Tokyo (JP)

(72) Inventors: Makoto Hidaka, Tokyo (JP); Satoshi Saito, Kanagawa (JP); Shohichi Satoh, Kanagawa (JP); Mamoru Kambayashi, Tokyo (JP); Tomomichi Hoshino, Kanagawa (JP); Atsushi Kikuchi, Kanagawa (JP); Kiyoshi Hata, Tokyo (JP); Keisuke Sugiyama, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 0 days.

(21) Appl. No.: 14/153,381

(22) Filed: Jan. 13, 2014

(65) Prior Publication Data

US 2014/0203488 A1 Jul. 24, 2014

(30) Foreign Application Priority Data

Jan. 18, 2013 (JP) ..... 2013-007714
Oct. 29, 2013 (JP) ..... 2013-224324

(51) Int. Cl.

| | |
|---|---|
| ***B31F 1/00*** | (2006.01) |
| ***B65H 37/04*** | (2006.01) |
| ***B65H 45/18*** | (2006.01) |
| *B65H 45/16* | (2006.01) |
| *B65H 45/12* | (2006.01) |
| *B65H 45/04* | (2006.01) |

(52) U.S. Cl.
CPC . *B31F 1/00* (2013.01); *B65H 45/16* (2013.01); *B31F 1/0035* (2013.01); *B65H 45/12* (2013.01); *B65H 45/04* (2013.01); *B31F 1/0006* (2013.01); *B65H 2801/27* (2013.01); *B65H 37/04* (2013.01); *B65H 45/18* (2013.01); *B65H 2301/51232* (2013.01); *B65H 2701/13212* (2013.01)

(58) Field of Classification Search
CPC ..... B31F 1/00; B31F 1/006; B31F 1/0035; B65H 45/04; B65H 45/12; B65H 2801/27
USPC ..... 270/32, 45, 58.07
See application file for complete search history.

(56) References Cited

U.S. PATENT DOCUMENTS 6,905,118 B2 * 6/2005 Yamada et al. ..... 270/8
7,744,073 B2 6/2010 Iguchi et al.

(Continued)

FOREIGN PATENT DOCUMENTS

JP 2009-001428 1/2009
JP 2012-020882 2/2012
JP 2012-030964 2/2012

*Primary Examiner* — Leslie A Nicholson, III
(74) *Attorney, Agent, or Firm* — Harness, Dickey & Pierce, P.L.C.

(57) ABSTRACT

A sheet processing apparatus includes: a pressing member that presses a fold part of a bundle of folded sheets so as to perform fold-enhancing; and a moving unit that moves a pressing position of the pressing member in a direction of a fold of the bundle of sheets. The moving unit starts pressing at an area located inside one end of the bundle of sheets while moving at a first velocity, and releases the pressing after passing through other end of the bundle of sheets during a forward movement, and starts pressing at an area located inside the other end of the bundle of sheets while moving at a second velocity that is higher than the first velocity, and passes through the one end of the bundle of sheets during a backward movement.

20 Claims, 21 Drawing Sheets

(56) References Cited

U.S. PATENT DOCUMENTS

| | | | | |
|---|---|---|---|---|
| 7,850,156 | B2 | 12/2010 | Iguchi et al. | |
| 7,905,474 | B2 | 3/2011 | Iguchi et al. | |
| 7,918,441 | B2 | 4/2011 | Iguchi et al. | |
| 7,922,160 | B2 | 4/2011 | Iguchi et al. | |
| 7,922,161 | B2 | 4/2011 | Iguchi et al. | |
| 7,922,162 | B2 * | 4/2011 | Kamiya | 270/45 |
| 7,942,396 | B2 | 5/2011 | Iguchi et al. | |
| 7,950,643 | B2 * | 5/2011 | Kawaguchi | 270/37 |
| 7,950,644 | B2 | 5/2011 | Iguchi et al. | |
| 7,997,571 | B2 | 8/2011 | Iguchi et al. | |
| 7,997,572 | B2 | 8/2011 | Iguchi et al. | |
| 8,002,255 | B2 * | 8/2011 | Kawaguchi et al. | 270/45 |
| 8,020,846 | B2 | 9/2011 | Iguchi et al. | |
| 8,083,218 | B2 * | 12/2011 | Dobashi et al. | 270/45 |
| 8,091,877 | B2 | 1/2012 | Iguchi et al. | |
| 8,162,304 | B2 | 4/2012 | Iguchi et al. | |
| 8,177,211 | B2 * | 5/2012 | Iguchi et al. | 270/45 |
| 8,342,497 | B2 * | 1/2013 | Abe | 270/45 |
| 8,342,498 | B2 * | 1/2013 | Urano | 270/45 |
| 8,505,902 | B2 | 8/2013 | Sugiyama et al. | |
| 2010/0239393 | A1 | 9/2010 | Suzuki et al. | |
| 2010/0258994 | A1 | 10/2010 | Kikkawa et al. | |
| 2010/0303585 | A1 | 12/2010 | Asami et al. | |
| 2010/0310340 | A1 | 12/2010 | Suzuki et al. | |
| 2011/0064541 | A1 | 3/2011 | Kikkawa et al. | |
| 2011/0091259 | A1 | 4/2011 | Kobayashi et al. | |
| 2011/0103919 | A1 | 5/2011 | Furuhashi et al. | |
| 2011/0103921 | A1 | 5/2011 | Suzuki et al. | |
| 2011/0176849 | A1 * | 7/2011 | Abe | 399/408 |
| 2012/0027428 | A1 * | 2/2012 | Terao | 399/21 |
| 2013/0012370 | A1 * | 1/2013 | Naraoka et al. | 493/454 |

* cited by examiner

SHEET PROCESSING APPARATUS, IMAGE FORMING SYSTEM, AND SHEET-BUNDLE FOLD-ENHANCING METHOD

CROSS-REFERENCE TO RELATED APPLICATIONS

The present application claims priority to and incorporates by reference the entire contents of Japanese Patent Application No. 2013-007714 filed in Japan on Jan. 18, 2013 and Japanese Patent Application No. 2013-224324 filed in Japan on Oct. 29, 2013.

BACKGROUND OF THE INVENTION

1. Field of the Invention

The present invention relates to a sheet processing apparatus, an image forming system, and a sheet-bundle fold enhancing method and, more particularly, to a sheet processing apparatus that has a function to perform folding on a sheet-like recording medium, such as paper, recording paper, or transfer paper (hereafter, simply referred to as "sheet" in this specification), to an image forming system that includes the sheet processing apparatus, and to a sheet-bundle fold-enhancing method that is performed by the sheet processing apparatus.

2. Description of the Related Art

In some of the conventional post-processing apparatuses that are used in combination with an image forming apparatus, such as a copier, one or more sheets are bound together at the center area of the sheets, and the bundle of sheets is folded at its center area by a pair of rollers that is arranged in parallel with a sheet fold direction, whereby a saddle-stitched booklet is produced. Furthermore, there is an already-known technique in which, in order to enhance the fold of the saddle-stitched booklet, fold-enhancing is performed by a roller that moves along the spine of the booklet.

In the above fold-enhancing technique, in order to perform fold-enhancing on the spine (the fold part) of a booklet (a bundle of sheets) by using a fold-enhancing roller, the roller stands by at the outer side of the booklet and is moved on the spine of the booklet.

However, because the moving velocity is constant, the moving velocity is low even at an area where the moving velocity can be made higher; therefore, it is difficult to improve productivity.

Furthermore, in a case where a driving motor is driven with constant current due to a current control, a current is set according to a setting that matches the highest load; therefore, unnecessary electric power is consumed at the area where the load is low, and it is difficult to improve energy saving performance.

Thus, the invention disclosed in, for example, Japanese Patent Application Laid-open No. 2012-20882 is known as a technique in consideration of productivity. According to the description of Japanese Patent Application Laid-open No. 2012-20882, a velocity control is performed such that, when a roller unit comes close to a staple (in a predetermined area that includes an end of the staple), the moving velocity becomes lower than a standard velocity (a first velocity) so that it is moved on the staple at a velocity (a second velocity) that is lower than the standard velocity and, after it passes through the staple, the velocity is increased so as to return to the standard velocity. Thus, a pair of fold-enhancing rollers is moved at a lower velocity from when it moves onto the staple to when it passes the staple; therefore, impact on a bundle of sheets is reduced. Moreover, damage on the pair of fold-enhancing rollers due to the staple is reduced compared to a case where it is moved on the staple at a higher velocity. Furthermore, because of the above velocity control, it is possible to shorten the total moving time of the fold-enhancing roller, compared to a case where it is moved at a lower velocity (the second velocity) over the entire staple.

Japanese Patent Application Laid-open No. 2012-20882 discloses that, when fold-enhancing is performed on the spine of the saddle-stitched booklet by using a pair of rollers, the moving velocity of the fold-enhancing roller is decreased at the staple area of the bundle of sheets so that damages are reduced. Furthermore, it is possible to shorten the total moving time of the fold-enhancing roller compared to a case where it is moved on the entire staple at a low velocity (the second velocity).

However, consideration is not given to minimizing the moving time during fold-enhancing to improve productivity.

There is a need to shorten the moving time during fold-enhancing so as to improve productivity.

SUMMARY OF THE INVENTION

It is an object of the present invention to at least partially solve the problems in the conventional technology.

A sheet processing apparatus includes: a pressing member that presses a fold part of a bundle of folded sheets so as to perform fold-enhancing; and a moving unit that moves a pressing position of the pressing member in a direction of a fold of the bundle of sheets. The moving unit starts pressing at an area located inside one end of the bundle of sheets while moving at a first velocity, and releases the pressing after passing through other end of the bundle of sheets during a forward movement, and starts pressing at an area located inside the other end of the bundle of sheets while moving at a second velocity that is higher than the first velocity, and passes through the one end of the bundle of sheets during a backward movement.

A sheet processing apparatus includes: a pressing member that presses a fold part of a bundle of folded sheets so as to perform fold-enhancing; and a moving unit that includes a driving source that moves a pressing position of the pressing member in a direction of a fold of the bundle of sheets. The moving unit starts pressing at an area located inside one end of the bundle of sheets while performing a movement by applying a first set current to the driving source, and releases the pressing after passing through other end of the bundle of sheets during a forward movement, and starts pressing at an area located inside the other end of the bundle of sheets while performing a movement by applying a second set current that is lower than the first set current, and passes through the one end of the bundle of sheets during a backward movement.

A sheet-bundle fold-enhancing method is performed by a sheet processing apparatus. The sheet processing apparatus includes: a pressing member that presses a fold part of a bundle of folded sheets so as to perform fold-enhancing; and a moving unit that moves a pressing position of the pressing member in a direction of a fold of the bundle of sheets. The sheet-bundle fold-enhancing method includes: a first step of performing a forward movement in a de-pressurized state of the pressing member by the moving unit and starting pressing at an area located inside one end of the bundle of sheets at a first velocity by using the pressing member; a second step of performing a forward movement in a pressurized state obtained at the first step and stopping at an area where the bundle of sheets is passed; a third step of entering a de-pressurized state after the second step and performing a backward movement to an area located inside other end of the bundle of sheets in a de-pressurized state; a fourth step of starting pressing at an area located inside the other end while performing a backward movement at a second velocity that is higher than the first velocity; and a fifth step of performing a backward movement in a pressurized state obtained at the fourth step and stopping at an area where the bundle of sheets is passed.

A sheet-bundle fold-enhancing method is performed by a sheet processing apparatus. The sheet processing apparatus includes: a pressing member that presses a fold part of a bundle of folded sheets so as to perform fold-enhancing; and a moving unit that includes a driving source that moves a pressing position of the pressing member in a direction of a fold of the bundle of sheets. The sheet-bundle fold-enhancing method includes: a first step of performing a forward movement in a de-pressurized state of the pressing member by the moving unit and starting pressing at an area located inside one end of the bundle of sheets while performing a movement by applying a first set current by using the pressing member; a second step of performing a forward movement in a pressurized state obtained at the first step and stopping at an area where the bundle of sheets is passed; a third step of entering a de-pressurized state after the second step and performing a backward movement to an area located inside other end of the bundle of sheets in a de-pressurized state; a fourth step of starting pressing at an area located inside the other end while performing a backward movement by applying a second set current that is lower than the first set current; and a fifth step of performing a backward movement in a pressurized state obtained at the fourth step and stopping at an area where the bundle of sheets is passed.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

The present invention is characterized in that a pair of rollers is moved back and forth relative to a bundle of sheets, fold-enhancing is once performed on a portion of the bundle of sheets to make it thin during a forward movement, and fold-enhancing is again performed from the thin portion of the bundle of sheets during a backward movement.

Exemplary embodiments of the present invention are explained below in detail with reference to the accompanying drawings.

Figure 1:
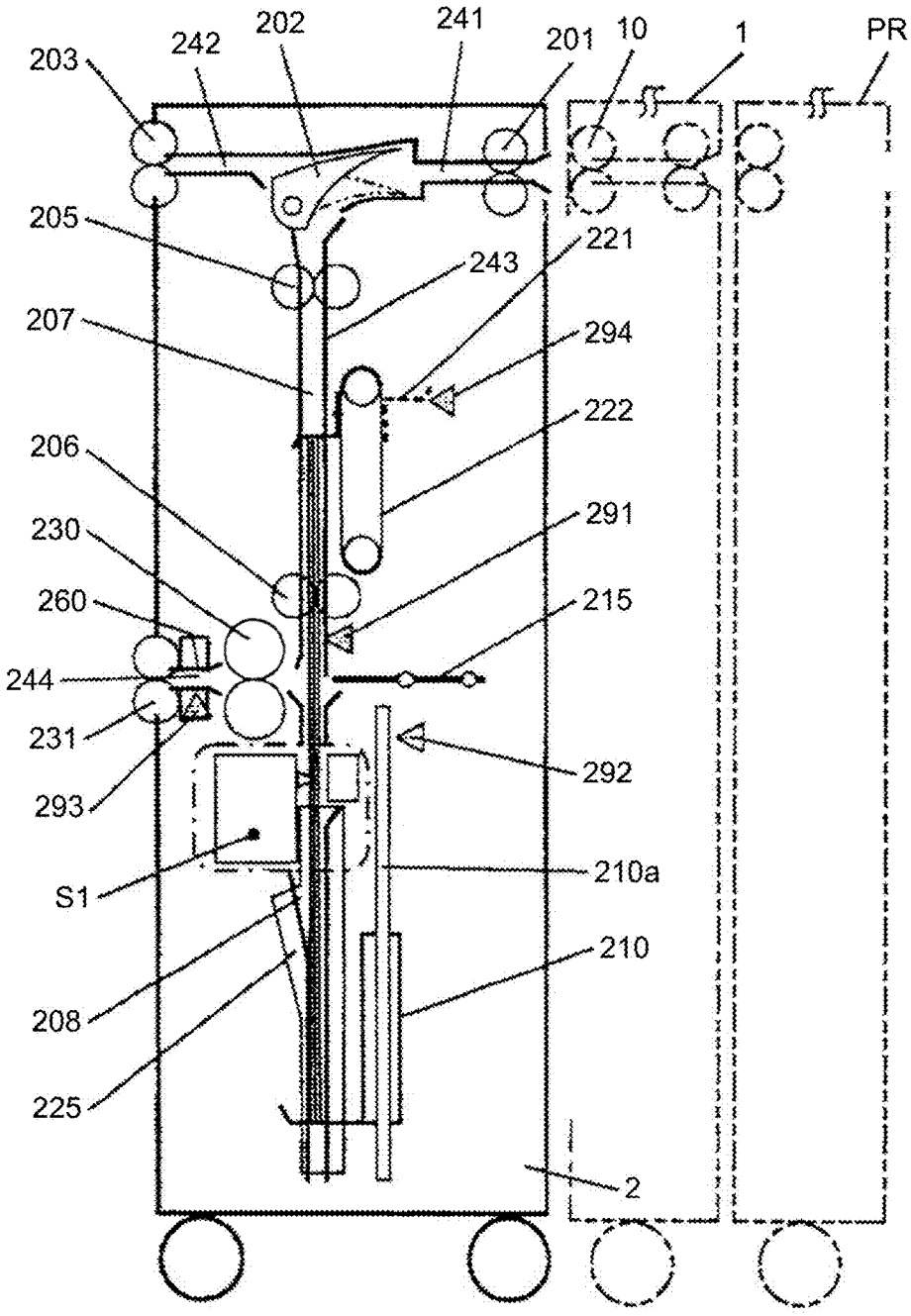
FIG. 1 is a diagram that illustrates a system configuration of an image forming system that includes an image forming apparatus and a plurality of sheet processing apparatuses according to an embodiment of the present invention.

FIG. 1 is a diagram that illustrates a system configuration of an image forming system according to the present embodiment that includes an image forming apparatus and a plurality of sheet processing apparatuses. In the present embodiment, first and second sheet post-processing apparatuses 1 and 2 are subsequently connected to an image forming apparatus PR in this order.

The first sheet post-processing apparatus 1 is a sheet post-processing apparatus that has a sheet-bundle making function, i.e., receives sheets one by one from the image forming apparatus PR, sequentially stacks them for alignment, and makes a bundle of sheets by using a stack unit. The first sheet post-processing apparatus 1 discharges a bundle of sheets to the subsequent second sheet post-processing apparatus 2 through a sheet-bundle discharge roller 10. The second sheet post-processing apparatus 2 is a saddle-stitching binding apparatus that receives a delivered bundle of sheets and performs saddle stitching and center folding (in this specification, the second sheet post-processing apparatus is also referred to as the saddle-stitching binding apparatus).

The saddle-stitching binding apparatus 2 discharges a bound booklet (a bundle of sheets) to the outside or discharges it to a subsequent sheet processing apparatus. The image forming apparatus PR forms visible images on a sheet-like recording medium by using input image data or image data of a read image. For example, it corresponds to a copier, printer, facsimile machine, or digital multifunction peripheral that has at least two functions out of the foregoing functions. The image forming apparatus PR uses a well-known system, such as an electrophotographic system or ink-jet system, and any image forming systems may be used.

As illustrated in FIG. 1, the saddle-stitching binding apparatus 2 includes an inlet conveyance path 241, a sheet through conveyance path 242, and a center-folding conveyance path 243. An inlet roller 201 is provided at the most upstream section of the inlet conveyance path 241 in a sheet conveying direction so that the bundle of aligned sheets is delivered into the apparatus through the sheet-bundle discharge roller 10 of the first sheet post-processing apparatus 1. In the following explanation, the upstream in a sheet conveying direction is simply referred to as the upstream, and the downstream in a sheet conveying direction is simply referred to as the downstream.

A bifurcating claw 202 is provided downstream of the inlet roller 201 at the inlet conveyance path 241. As illustrated, the bifurcating claw 202 is arranged in a horizontal direction so as to bifurcate the conveying direction of a bundle of sheets into the sheet through conveyance path 242 or the center-folding conveyance path 243. The sheet through conveyance path 242 is a conveyance path that horizontally extends from the inlet conveyance path 241 so as to guide a bundle of sheets into an undepicted subsequent processing apparatus or discharge tray, and a bundle of sheets is subsequently discharged by an upper discharge roller 203. The center-folding conveyance path 243 is a conveyance path that extends vertically downward from the bifurcating claw 202 so as to perform a saddle-stitching and center-folding process on a bundle of sheets.

The center-folding conveyance path 243 includes an upper bundle-conveyance guide plate 207 that guides a bundle of sheets in the section above a folding plate 215 for center-folding and includes a lower bundle-conveyance guide plate 208 that guides a bundle of sheets in the section below the folding plate 215. At the upper bundle-conveyance guide plate 207 are provided, starting from the top, an upper bundle-conveyance roller 205, a trailing-edge tapping claw 221, and a lower bundle-conveyance roller 206. The trailing-edge tapping claw 221 is provided so as to stand on a trailing-edge tapping claw drive belt 222 that is driven by an undepicted drive motor. The trailing-edge tapping claw 221 taps (pushes) the trailing edge of a bundle of sheets toward a movable fence, which will be explained later, in accordance with an back-and-forth rotation operation of the trailing-edge tapping claw drive belt 222, thereby performing an operation to align the bundle of sheets. Furthermore, when a bundle of sheets is carried in, or when a bundle of sheets is lifted up for center-folding, the trailing-edge tapping claw 221 is retracted from the center-folding conveyance path 243 of the upper bundle-conveyance guide plate 207 (the position of the dashed line in FIG. 1).

The reference numeral 294 denotes a trailing-edge tapping claw HP sensor that detects the home position of the trailing-edge tapping claw 221, and detects, as the home position, the position of the dashed line in FIG. 1 (the position of the solid line in FIG. 2) where the trailing-edge tapping claw 221 is retracted from the center-folding conveyance path 243. The trailing-edge tapping claw 221 is controlled by using the home position as a reference.

At the lower bundle-conveyance guide plate 208 are provided, starting from the top, a saddle-stitching stapler S1, saddle-stitching jogger fences 225, and a movable fence 210. The lower bundle-conveyance guide plate 208 is a guide plate that receives a bundle of sheets that is conveyed through the upper bundle-conveyance guide plate 207. The pair of saddle-stitching jogger fences 225 are provided along the width direction, and the movable fence 210 is provided at the lower such that the leading edge of a bundle of sheets is brought into contact with (supported by) it and it is movable in a vertical direction.

The saddle-stitching stapler S1 is a stapler that binds a bundle of sheets at the center section thereof. The movable fence 210 is vertically moved while supporting the leading edge of a bundle of sheets, and positions the center position of the bundle of sheets at a position opposed to the saddle-stitching stapler S1, whereby a stapling process, i.e., saddle stitching, is performed at the position. The movable fence 210 is supported by a movable-fence driving mechanism 210*a*, and it is movable from the position of a movable-fence HP sensor 292, which is located in the upper section in the drawing, to the lowest position. It is ensured that the movable range of the movable fence 210 with which the leading edge of a bundle of sheets is brought into contact is a stroke for processing sizes, i.e., from the largest size to the smallest size that can be processed by the saddle-stitching binding apparatus 2.

For example, a rack-and-pinion mechanism is used as the movable-fence driving mechanism 210*a*.

The folding plate 215, a pair of folding rollers 230, a fold-enhancing roller unit 260, and a lower discharge roller 231 are provided between the upper bundle-conveyance guide plate 207 and the lower bundle-conveyance guide plate 208, i.e., substantially at the middle section of the center-folding conveyance path 243. In the fold-enhancing roller unit 260, upper and lower fold-enhancing rollers are provided with a discharge conveyance path interposed therebetween, and the discharge conveyance path is sandwiched between the pair of folding rollers 230 and the lower discharge roller 231. The folding plate 215 is movable back and forth in a horizontal direction in the drawing, the nip between the pair of folding rollers 230 is located in an operational direction when a folding operation is performed, and the discharge conveyance path 244 is provided continuously from the nip. The lower discharge roller 231 is provided on the most downstream of the discharge conveyance path 244 so as to subsequently discharge a bundle of sheets on which a folding operation has been performed.

A sheet-bundle detection sensor 291 is provided on the lower end side of the upper bundle-conveyance guide plate 207 so as to detect the leading edge of a bundle of sheets that is conveyed to the center-folding conveyance path 243 and passes through the center-folding position. Furthermore, a fold part passage sensor 293 is provided on the discharge conveyance path 244 so as to detect the leading edge of the bundle of center-folded sheets and detect the passage of the bundle of sheets.

In general, in the saddle-stitching binding apparatus 2 that is configured as illustrated in FIG. 1, saddle-stitching and center-folding operations are performed as illustrated in the operation explanatory diagrams of FIGS. 2 to 6. Specifically, when saddle stitching and center-folding are selected via an undepicted operation panel of the image forming apparatus PR, the bundle of sheets for which saddle stitching and center-folding are selected is guided to the center-folding conveyance path 243 in accordance with a bias movement of the bifurcating claw 202 in a counterclockwise direction. Furthermore, the bifurcating claw 202 is driven by a solenoid. It may be driven by a motor instead of a solenoid.

Figure 2:
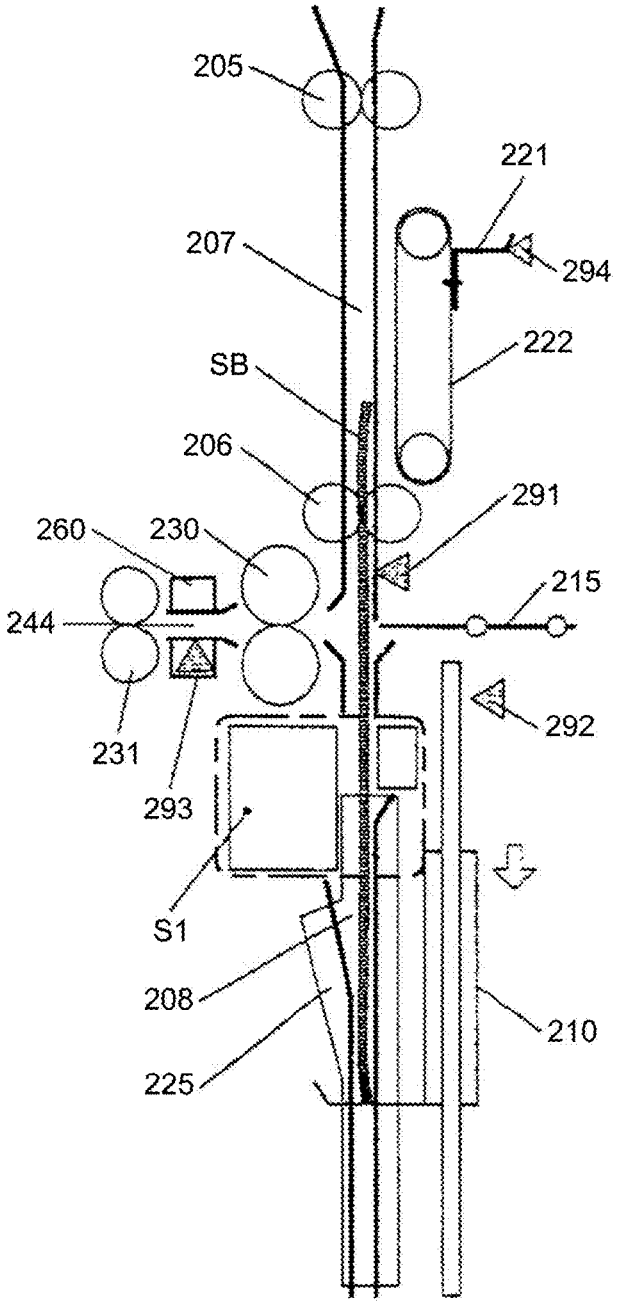
FIG. 2 is an operation explanatory diagram of a saddle-stitching binding apparatus and illustrates a state where a bundle of sheets is conveyed into a center-folding conveyance path.

When a bundle of sheets SB is conveyed to the center-folding conveyance path 243, it is conveyed downward through the center-folding conveyance path 243 by the inlet roller 201 and the upper bundle-conveyance roller 205 and, after its passage is detected by the sheet-bundle detection sensor 291, is conveyed by the lower bundle-conveyance roller 206 to a position where the leading edge of the bundle of sheets SB is brought into contact with the movable fence 210, as illustrated in FIG. 2. At that time, the movable fence 210 stands by at a different stop position in accordance with the sheet size information that is received from the image forming apparatus PR, here, the size information on each bundle of sheets SB in a conveying direction. Here, in FIG. 2, the bundle of sheets SB is sandwiched between the lower bundle-conveyance rollers 206 at the nip thereof, and the trailing-edge tapping claw 221 stands by at the home position.

Figure 3:
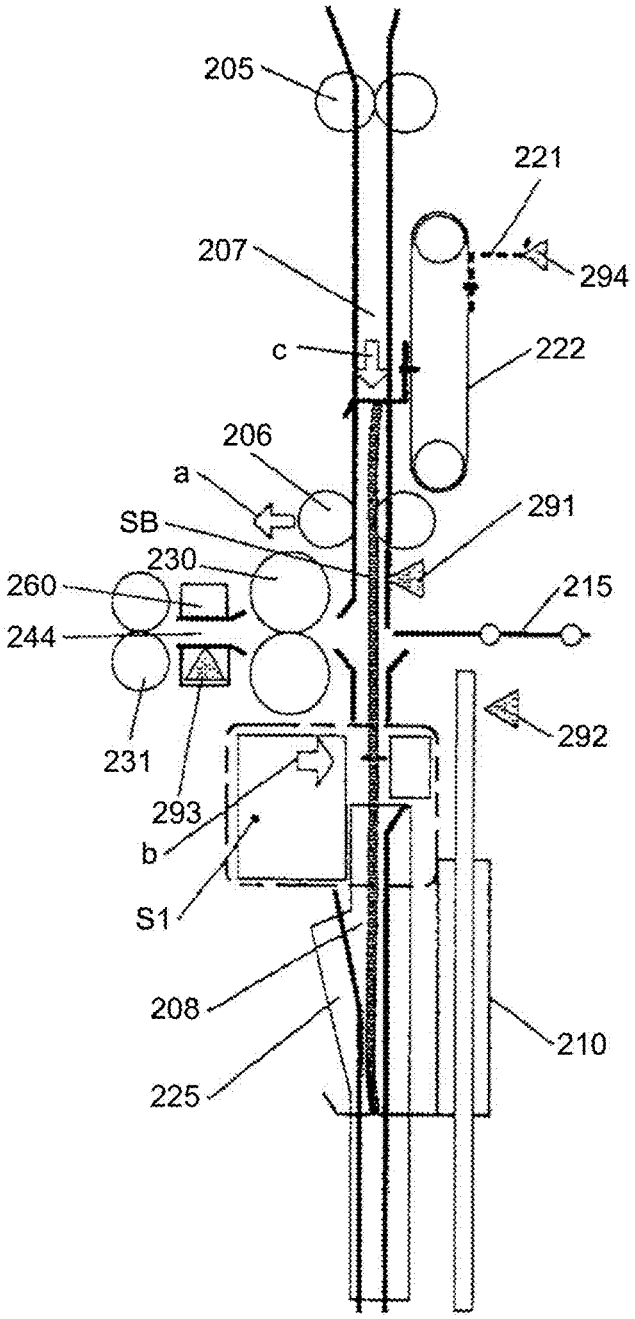
FIG. 3 is an operation explanatory diagram of the saddle-stitching binding apparatus and illustrates a state where the bundle of sheets is saddle-stitched.

In the above state, as illustrated in FIG. 3, the nip pressure of the lower bundle-conveyance rollers 206 is released (the direction of the arrow a), the leading edge of the bundle of sheets is brought into contact with the movable fence 210 so that they are stacked in a state where the trailing edge thereof is free, and then the trailing-edge tapping claw 221 is driven so as to tap the trailing edge of the bundle of sheets SB for final alignment in the conveying direction (the direction of the arrow c).

Next, an alignment operation is performed by the saddle-stitching jogger fences 225 in a width direction (a direction perpendicular to the sheet conveying direction), and an alignment operation is performed by the movable fence 210 and the trailing-edge tapping claw 221 in the conveying direction, whereby the alignment operation on the bundle of sheets SB in the width direction and in the conveying direction are completed. Here, the degree of pressure applied by the trailing-edge tapping claw 221 and the saddle-stitching jogger fences 225 are changed to an optimum value for alignment in accordance with the information on the sheet size, the information on the number of sheets in the bundle, and the information on the thickness of the bundle of sheets.

If the bundle is thick, the space within the conveyance path is decreased; therefore, in many cases, alignment is not completed during a single alignment operation. Therefore, in such a case, the number of times alignment is performed is increased. Thus, a desirable alignment condition can be obtained. Furthermore, as the number of sheets is increased, the time it takes for the sheets to be sequentially stacked at the upstream is increased; therefore, it takes a longer time to receive the subsequent bundle of sheets SB. As a result, although the number of times alignment is performed is increased, there is no time loss in the system; therefore, a desired alignment condition can be obtained in an effective manner. Thus, the number of times alignment is performed can be controlled in accordance with the processing time on the upstream.

Furthermore, the standby position of the movable fence 210 is usually set in a position such that the saddle-stitching position of the bundle of sheets SB is opposed to the stitching position of the saddle-stitching stapler S1 . If alignment is performed in this position, a stitching operation can be continuously performed in a position where the bundle of sheets SB is stacked without moving the movable fence 210 to the saddle-stitching position of the bundle of sheets SB. Therefore, a stitcher of the saddle-stitching stapler S1 is moved to the center section of the bundle of sheets SB in the direction of the arrow b while in the standby position, and a stitching operation is performed by the stitcher and a clincher, whereby the bundle of sheets SB is saddle-stitched.

The movable fence 210 is positioned in accordance with a control on pulses from the movable-fence HP sensor 292, and the trailing-edge tapping claw 221 is positioned in accordance with a control on pulses from the trailing-edge tapping claw HP sensor 294. The positioning control on the movable fence 210 and the trailing-edge tapping claw 221 is performed by a CPU of an undepicted control circuit of the saddle-stitching binding apparatus 2.

Figure 4:
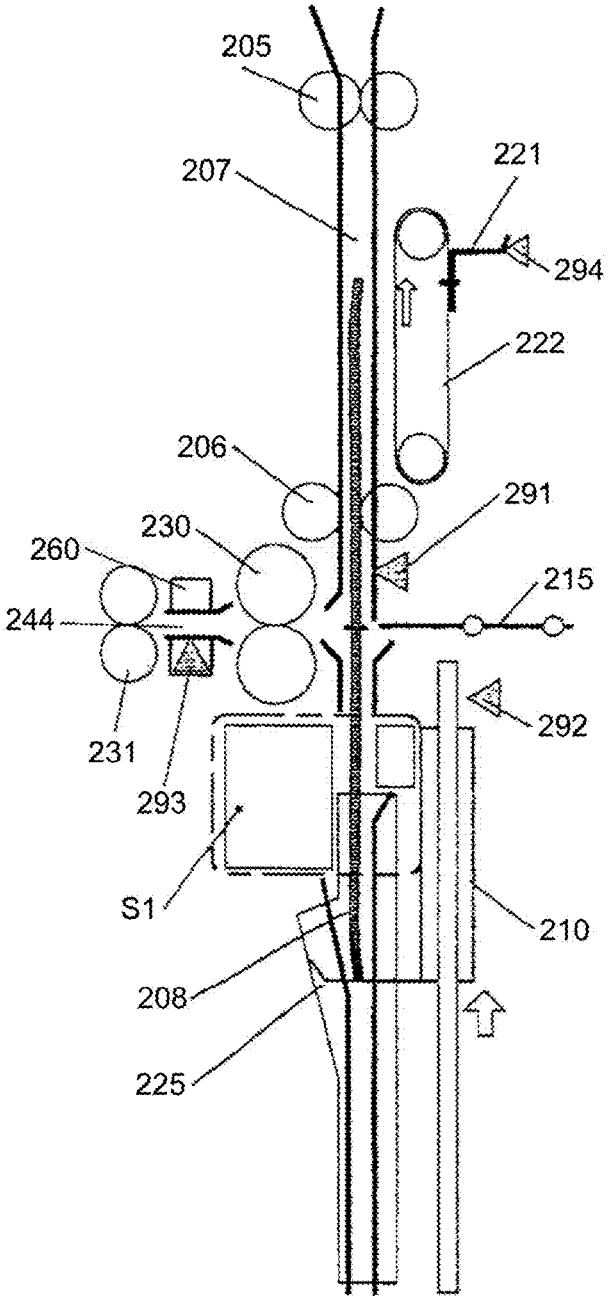
FIG. 4 is an operation explanatory diagram of the saddle-stitching binding apparatus and illustrates a state where a movement of the bundle of sheets to a center-folding position is completed.

After saddle stitching is performed on the bundle of sheets SB in the state illustrated in FIG. 3, the bundle of sheets SB is conveyed to a position where the saddle-stitching position (the middle position of the bundle of sheets SB in the conveying direction) is opposed to the folding plate 215 in accordance with the upward movement of the movable fence 210 while the pressure of the lower bundle-conveyance roller 206 is released as illustrated in FIG. 4. This position is also controlled by using the detection position of the movable-fence HP sensor 292 as a reference.

Figure 5:
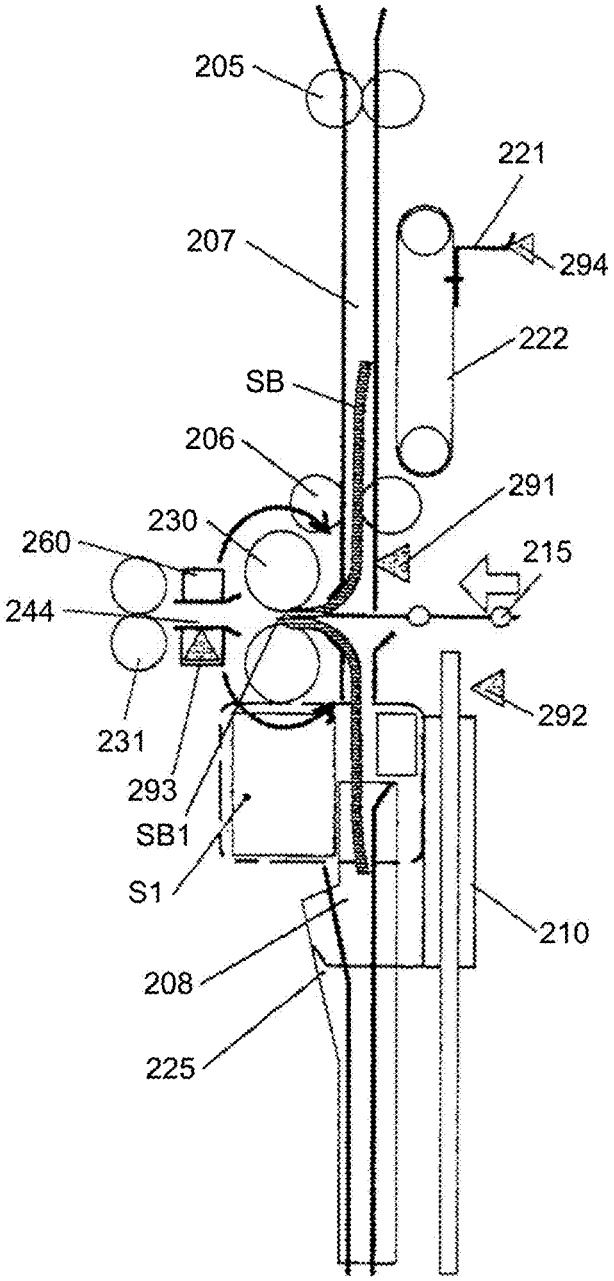
FIG. 5 is an operation explanatory diagram of the saddle-stitching binding apparatus and illustrates a state where a center-folding operation is performed on the bundle of sheets.

When the bundle of sheets SB reaches the position as illustrated in FIG. 4, the folding plate 215 is moved toward the nip of the pair of folding rollers 230, as illustrated in FIG. 5, and is brought into contact with the bundle of sheets SB in the vicinity of a stitch part, at which the bundle of sheets SB is stitched, in a direction substantially perpendicular to the bundle of sheets SB so as to push it toward the nip. The bundle of sheets SB is pushed by the folding plate 215 so as to be guided to the nip of the pair of folding rollers 230, whereby the bundle of sheets SB is pushed into the nip of the pair of folding rollers 230 that has been already rotating. The pair of folding rollers 230 presses the bundle of sheets SB, which has been pushed into the nip, and conveys it. By this pressing and conveying operation, the bundle of sheets SB is folded at the center thereof, whereby the bundle of sheets SB is formed to be a simple booklet. FIG. 5 illustrates a state where the end of a fold part SB1 of the bundle of sheets SB is sandwiched in the nip of the pair of folding rollers 230 and is pressed thereby.

Figure 6:
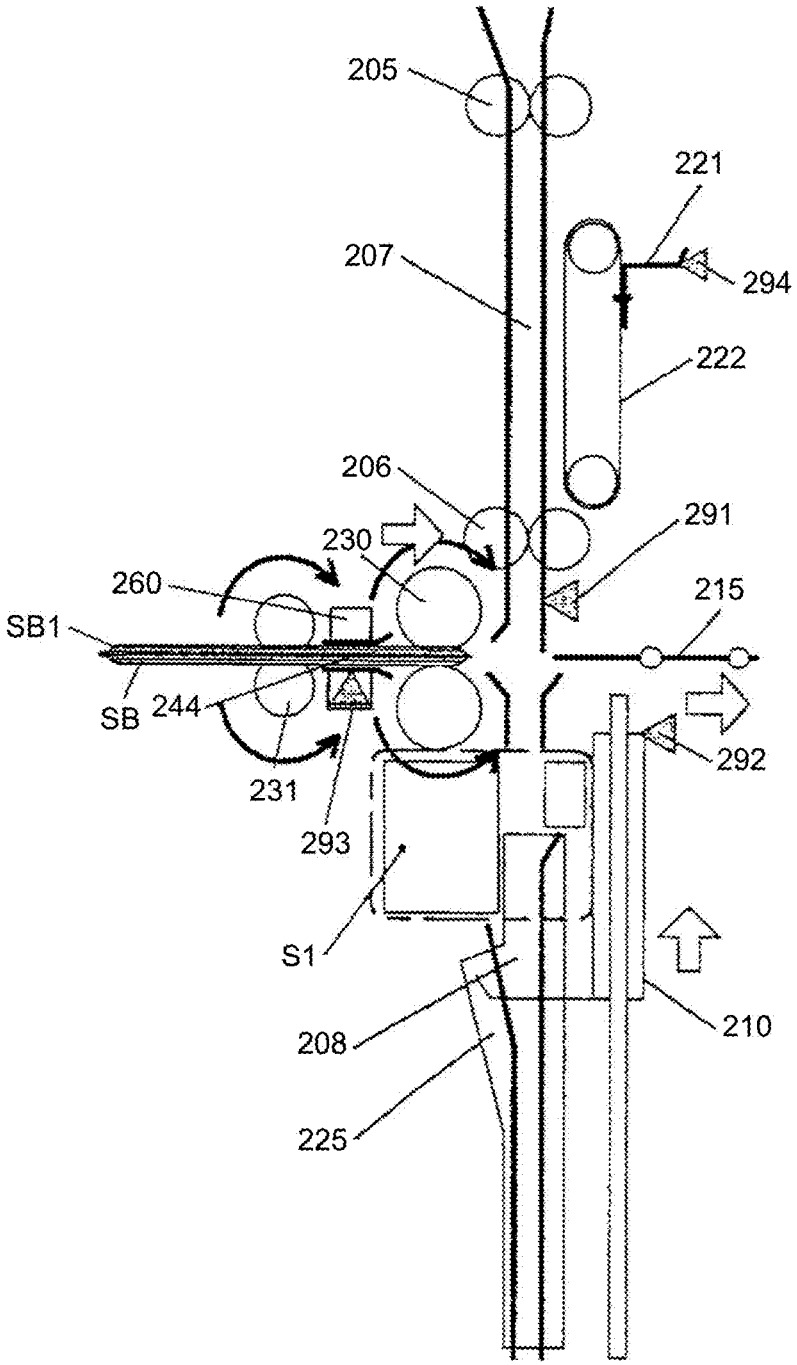
FIG. 6 is an operation explanatory diagram of the saddle-stitching binding apparatus and illustrates a state where the bundle of sheets is discharged after center-folding is completed.

After the bundle of sheets SB is folded in two at the center section thereof in the state illustrated in FIG. 5, the bundle of sheets SB is conveyed by the pair of folding rollers 230 as illustrated in FIG. 6 and is nipped by the lower discharge roller 231 so as to be discharged subsequently. Here, when the trailing edge of the bundle of sheets SB is detected by the fold part passage sensor 293, the folding plate 215 and the movable fence 210 are returned to their home positions, and the lower bundle-conveyance roller 206 is returned to the state of being pressurized, whereby they stand by for the subsequent bundle of sheets SB to be conveyed. If the next job specifies the same size and the same number of sheets, the movable fence 210 may be moved to the position again as illustrated in FIG. 2 and stand by. The above control is also performed by the CPU of the above-described control circuit.

Figure 7:
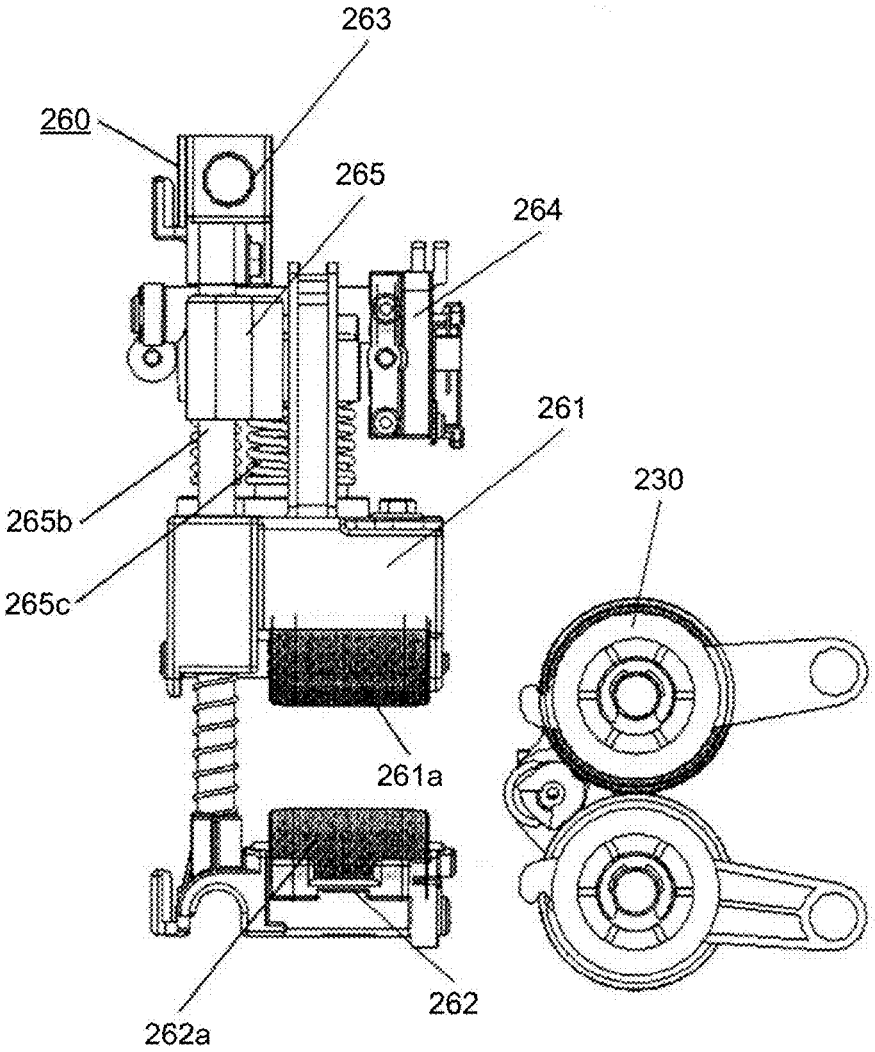
FIG. 7 is a relevant-part front view that illustrates a fold-enhancing roller unit and a pair of folding rollers.
Figure 8:
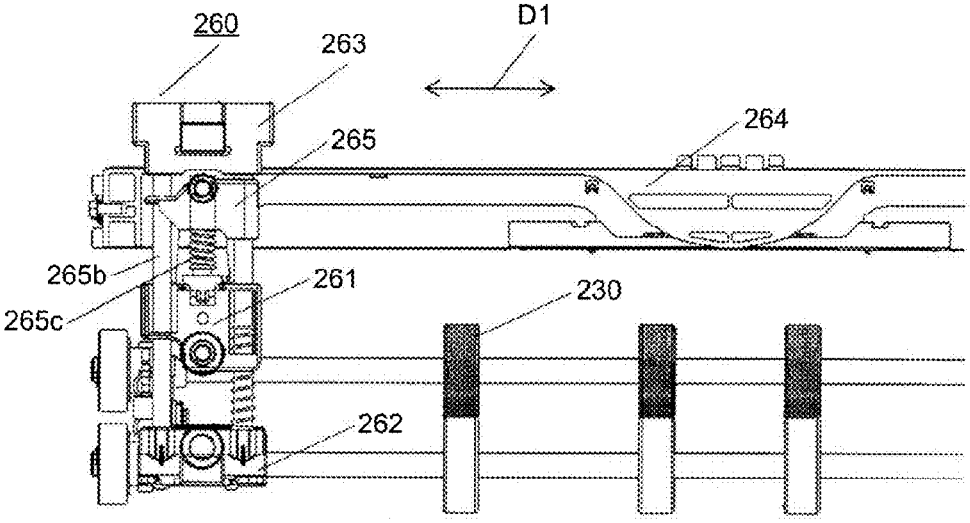
FIG. 8 is a relevant-part side view when viewed from the left side of FIG. 7.

FIG. 7 is a relevant-part front view that illustrates the fold-enhancing roller unit and the pair of folding rollers, and FIG. 8 is a relevant-part side view when viewed from the left side of FIG. 7. The fold-enhancing roller unit 260 is provided on the discharge conveyance path 244 that is between the pair of folding rollers 230 and the lower discharge roller 231, and it includes a unit moving mechanism 263, a guide member 264, and a pressing mechanism 265. The unit moving mechanism 263 uses an undepicted driving source and an undepicted driving mechanism to move the fold-enhancing roller unit 260 back and forth along the guide member 264 in a deep direction of the drawing (in a direction perpendicular to the sheet conveying direction). The pressing mechanism 265 is a mechanism that applies pressure in a vertical direction so as to press the bundle of sheets SB and that includes a fold-enhancing roller/upper unit 261 and a fold-enhancing roller/lower unit 262.

The fold-enhancing roller/upper unit 261 is supported by a support member 265*b* such that it is movable in a vertical direction relative to the unit moving mechanism 263, and the fold-enhancing roller/lower unit 262 is secured to the lower end of the support member 265*b* of the pressing mechanism 265 in an unmovable manner. An upper fold-enhancing roller 261*a* of the fold-enhancing roller/upper unit 261 can be brought into contact with and be pressed against a lower fold-enhancing roller 262*a* so that the bundle of sheets SB is interposed in the nip between them and is pressed. The pressure is applied by a pressure spring 265*c* that uses its elastic force to press the fold-enhancing roller/upper unit 261. Then, it moves in the width direction of the bundle of sheets SB (in the direction of the arrow D1 in FIG. 8) in the state of being pressurized, as described below, so as to perform fold-enhancing on the fold part SB1.

Figure 9:
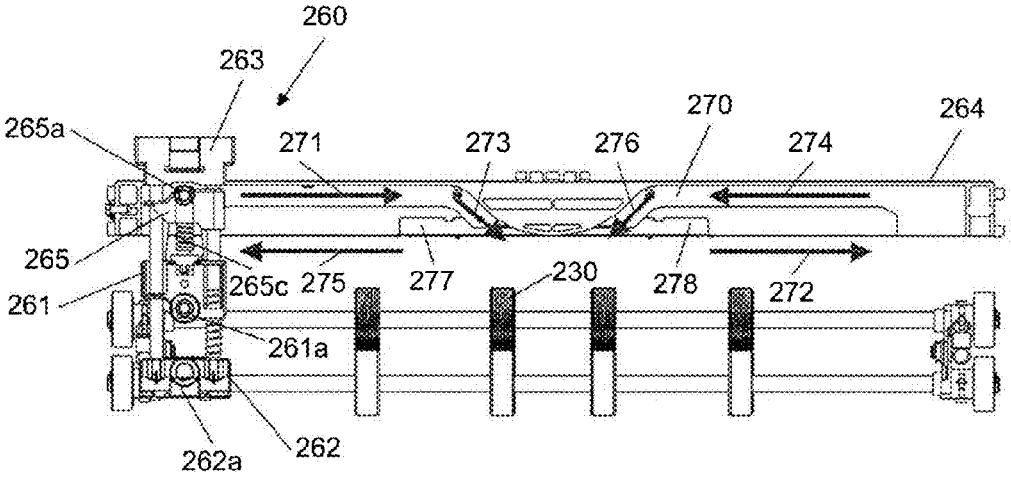
FIG. 9 is a diagram that illustrates the details of a guide member.

FIG. 9 is a diagram that illustrates the details of the guide member 264. The guide member 264 includes a guide path 270 for guiding the fold-enhancing roller unit 260 in the width direction of the bundle of sheets SB, and the guide path 270 has six paths specified as follows:

1) a first guide path 271 for guiding the pressing mechanism 265 in a de-pressurized state during a forward movement;
2) a second guide path 272 for guiding the pressing mechanism 265 in a pressurized state during a forward movement;
3) a third guide path 273 for switching the pressing mechanism 265 from the de-pressurized state to the pressurized state during a forward movement;
4) a fourth guide path 274 for guiding the pressing mechanism 265 during a backward movement in a de-pressurized state;
5) a fifth guide path 275 for guiding the pressing mechanism 265 in a pressurized state during a backward movement; and
6) a sixth guide path 276 for switching the pressing mechanism 265 from the de-pressurized state to the pressurized state during a backward movement.

Figure 10:
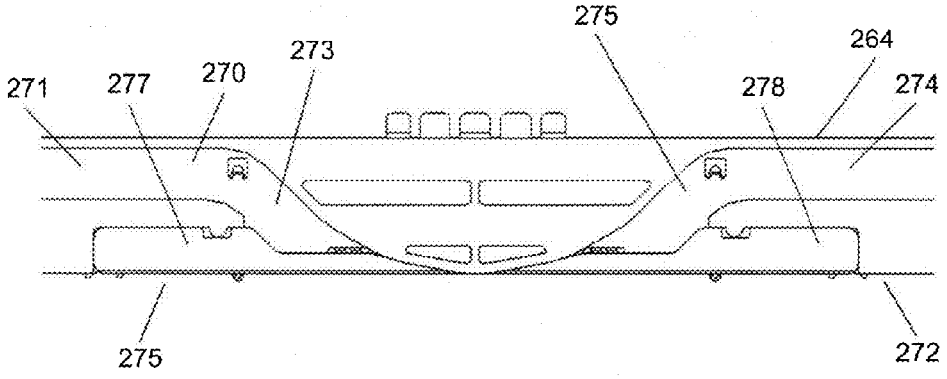
FIG. 10 is a diagram that illustrates a relevant part of FIG. 9 in an enlarged manner and illustrates a state where path switching claws are not switched.
Figure 11:
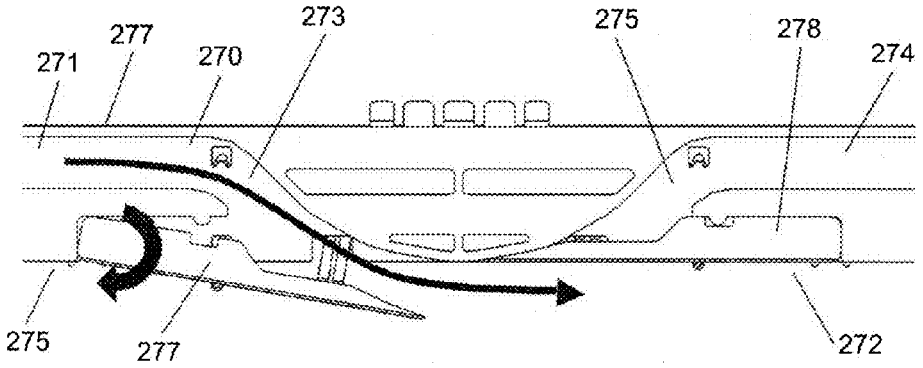
FIG. 11 is a diagram that illustrates a relevant part of FIG. 9 in an enlarged manner and illustrates a state where a first path switching claw is switched.

FIGS. 10 and 11 are diagrams that illustrate a relevant part of FIG. 9 in an enlarged manner. As illustrated in FIGS. 10 and 11, a first path switching claw 277 is provided at the intersection of the third guide path 273 and the second guide path 272, and a second path switching claw 278 is provided at the intersection of the sixth guide path 276 and the fifth guide path 275. As illustrated in FIG. 11, the first path switching claw 277 enables a switch from the third guide path 273 to the second guide path 272, and the second path switching claw 278 enables a switch from the sixth guide path 276 to the fifth guide path 275. However, the former disables a switch from the second guide path 272 to the third guide path 273, and the latter disables a switch from the fifth guide path 275 to the sixth guide path 276. That is, a configuration is such that a switch in an opposite direction is disabled. The arrow in FIG. 11 indicates the movement trajectory of a guide pin 265*a*.

Furthermore, the pressing mechanism 265 is moved along the guide path 270 because the guide pin 265*a* of the pressing mechanism 265 is loosely fitted into and is movably engaged in the guide path 270. Specifically, the guide path 270 serves as a cam groove, and the guide pin 265*a* serves as a cam follower that changes its position while it moves along the cam groove.

FIGS. 12 to 22 are operation explanatory diagrams of a fold-enhancing operation performed by the fold-enhancing roller unit according to the present embodiment.

Figure 12:
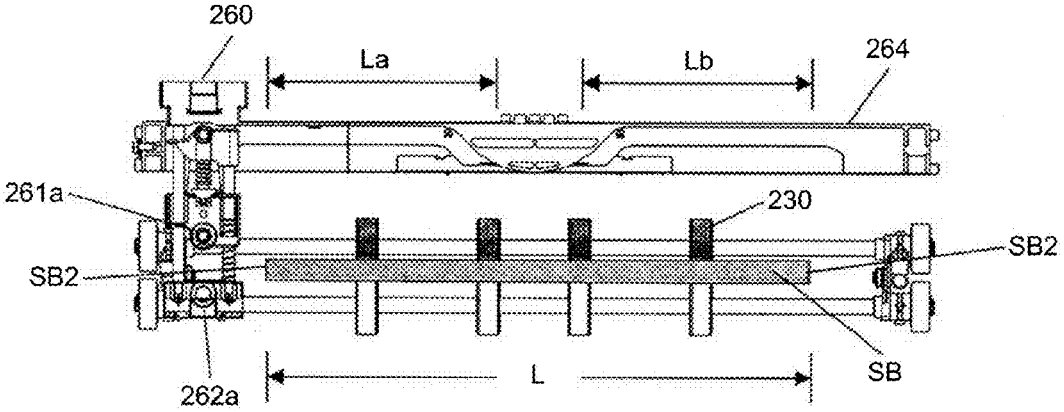
FIG. 12 is an operation explanatory diagram that illustrates the initial condition during a fold-enhancing operation.

FIG. 12 illustrates a state where the bundle of sheets SB, which has been folded by the pair of folding rollers 230, is conveyed to and stopped at the previously set fold-enhancing position and the fold-enhancing roller unit 260 is located at the standby position. This state is the initial position during a fold-enhancing operation.

Figure 13:
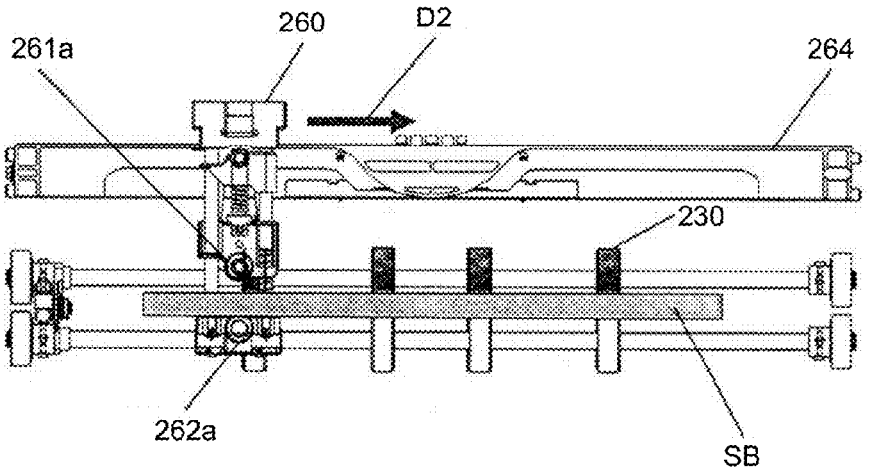
FIG. 13 is an operation explanatory diagram that illustrates a state where a forward movement of a fold-enhancing roller unit is started.

The fold-enhancing roller unit 260 starts a forward movement from the initial position (FIG. 12) to the right in the drawing (in the direction of the arrow D2) (FIG. 13). At that time, the pressing mechanism 265 of the fold-enhancing roller unit 260 moves along the guide path 270 of the guide member 264 in accordance with an action of the guide pin 265*a*. It moves along the first guide path 271 immediately after the operation is started. At that time, the pair of fold-enhancing rollers 261*a* and 262*a* is in a de-pressurized state. Here, the de-pressurized state means the state where the pair of fold-enhancing rollers 261*a* and 262*a* are in contact with the bundle of sheets SB although pressure is hardly applied or the state where the pair of fold-enhancing rollers 261*a* and 262*a* is located away from the bundle of sheets SB. The pair of fold-enhancing rollers 261*a* and 262*a* includes the upper fold-enhancing roller 261*a* and the lower fold-enhancing roller 262*a* as a pair.

Figure 14:
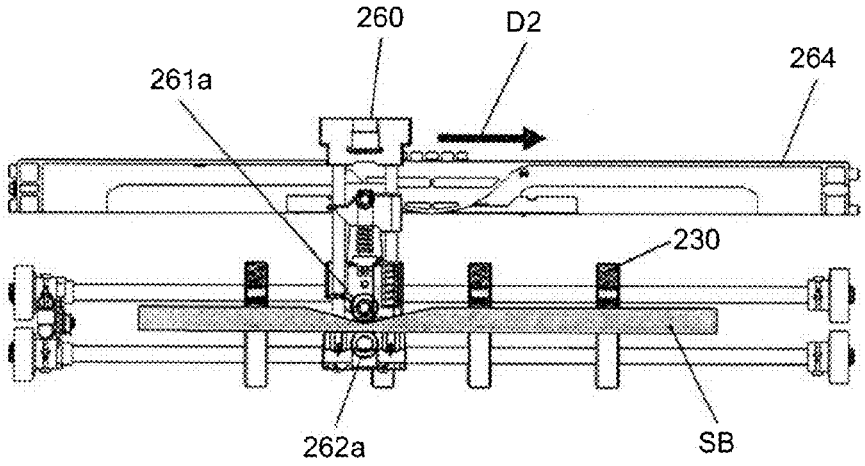
FIG. 14 is an operation explanatory diagram that illustrates a state where the fold-enhancing roller unit reaches a third guide path near the center of the bundle of sheets.
Figure 15:
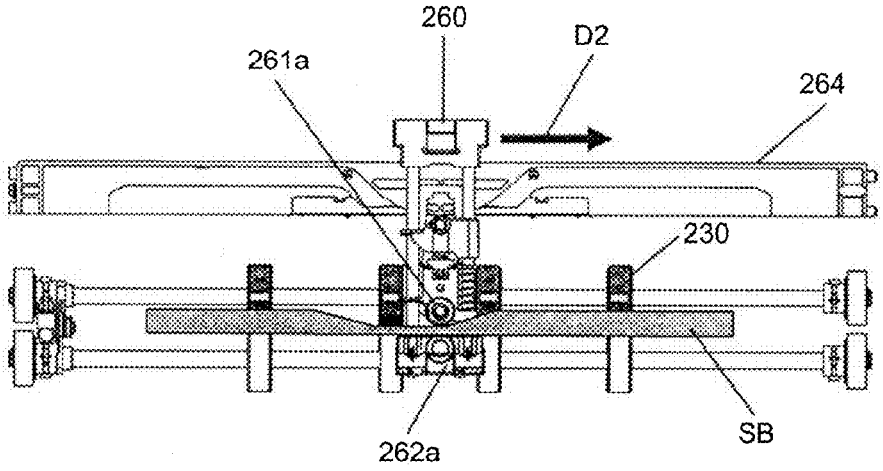
FIG. 15 is an operation explanatory diagram that illustrates a state where the fold-enhancing roller unit pushes a first path switching claw and enters a second guide path.
Figure 23:
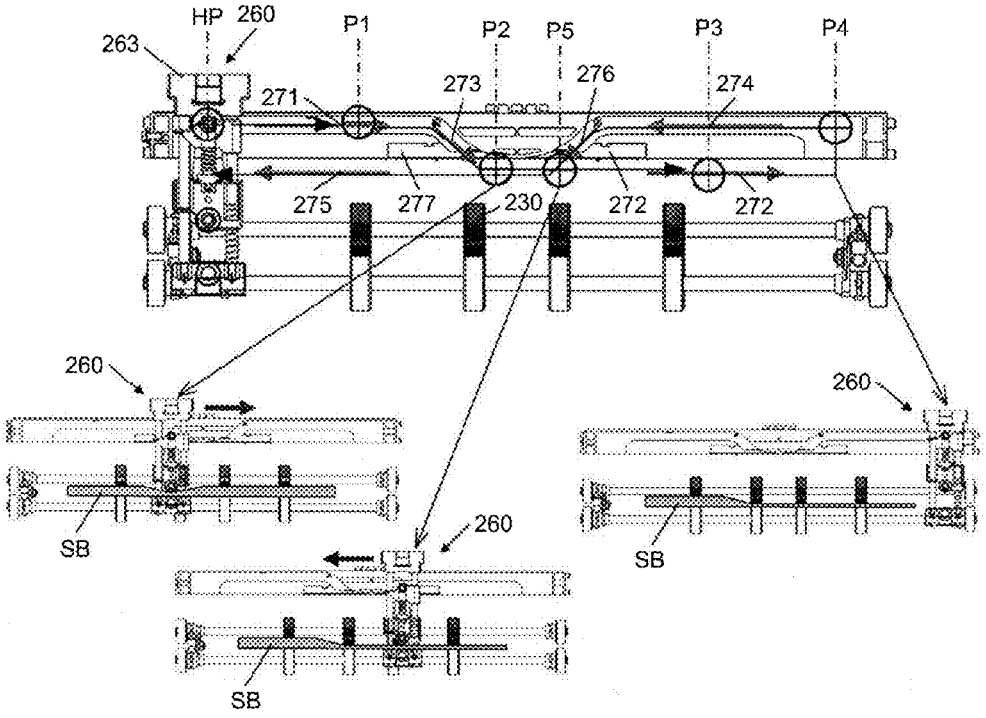
FIG. 23 is an explanatory diagram that illustrates various points when the fold-enhancing roller unit is moved by a unit moving mechanism and the state of the fold-enhancing roller unit at points.

When the pressing mechanism 265 reaches the third guide path 273 while it is located inside one end of the bundle of sheets SB (FIG. 14) (although it is desirably in the central portion of the bundle of sheets as illustrated in FIG. 14, it may be in the vicinity of one end of the bundle of sheets SB as illustrated in FIG. 23), the pressing mechanism 265 starts to move downward along the third guide path 273 and pushes the first path switching claw 277 so as to enter the second guide path 272 (FIG. 15). At that time, the pressing mechanism 265 is in a state where it presses the fold-enhancing roller/upper unit 261, and the fold-enhancing roller/upper unit 261 is in a pressurized state and is in contact with the bundle of sheets SB.

Figure 16:
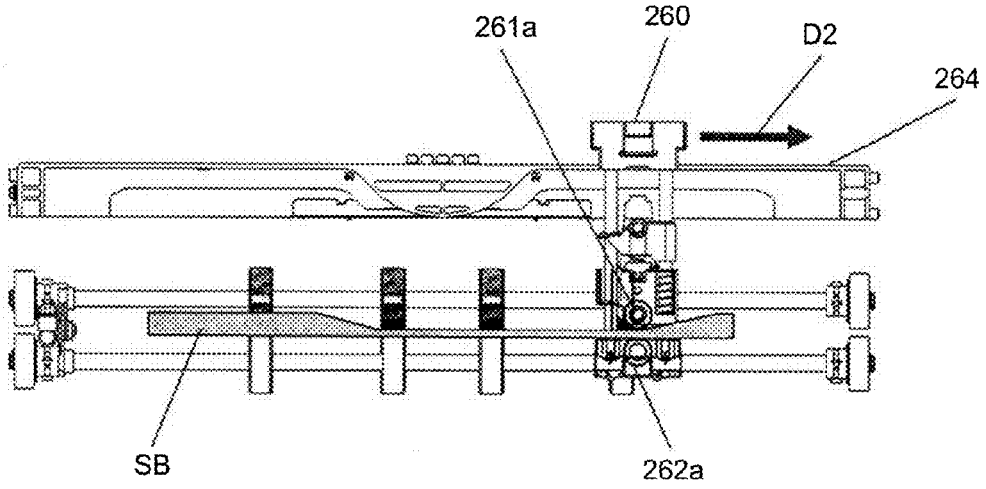
FIG. 16 is an operation explanatory diagram that illustrates a state where the fold-enhancing roller unit moves toward the end of the bundle of sheets while pressing the bundle of sheets.
Figure 17:
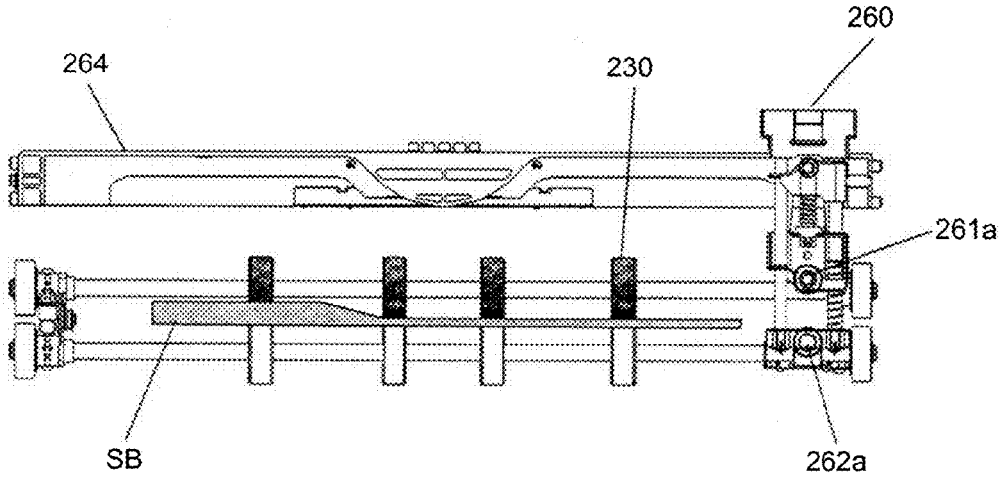
FIG. 17 is an operation explanatory diagram that illustrates a state where the fold-enhancing roller unit moves to the final position of the forward movement along a second guide path.

The fold-enhancing roller unit 260 is further moved in the direction of the arrow D2 in a pressurized state (FIG. 16). At that time, as the second path switching claw 278 disables a movement in an opposite direction, it is moved along the second guide path 272 without being guided to the sixth guide path 276, is moved beyond the bundle of sheets SB, and is located at the final position of the forward movement (FIG. 17). When it is moved here, the guide pin 265*a* of the pressing mechanism 265 is moved from the second guide path 272 to the fourth guide path 274 that is located above. As a result, the restraint on the position of the guide pin 265*a* due to the upper surface of the second guide path 272 is released; therefore, the upper fold-enhancing roller 261*a* is moved away from the lower fold-enhancing roller 262*a* and enters a de-pressurized state.

Figure 18:
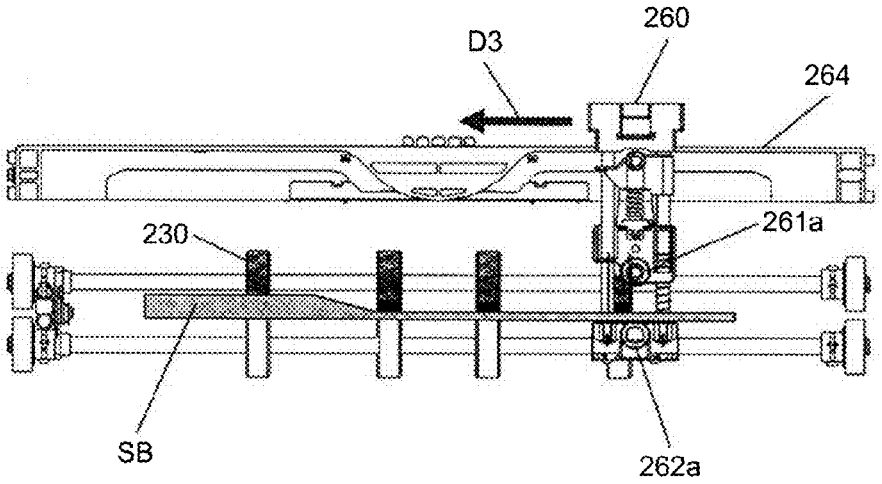
FIG. 18 is an operation explanatory diagram that illustrates a state where the fold-enhancing roller unit starts a backward movement from the final position of the forward movement.
Figure 19:
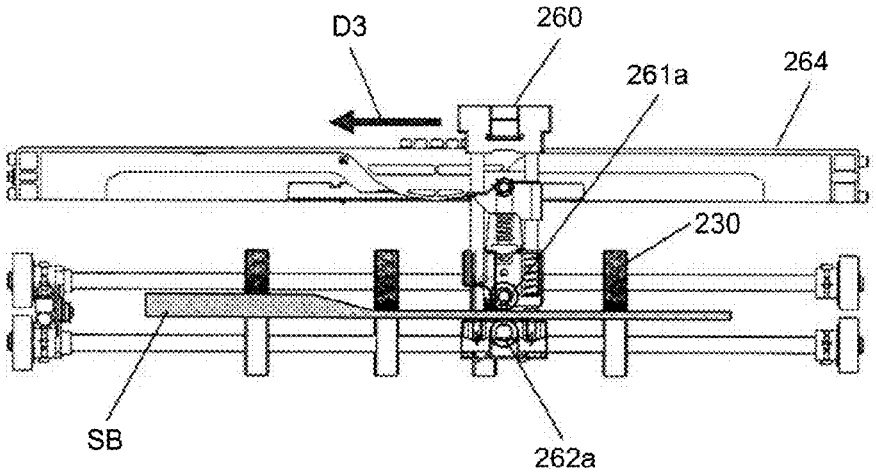
FIG. 19 is an operation explanatory diagram that illustrates a state where the fold-enhancing roller unit starts a backward movement and reaches a sixth guide path.
Figure 20:
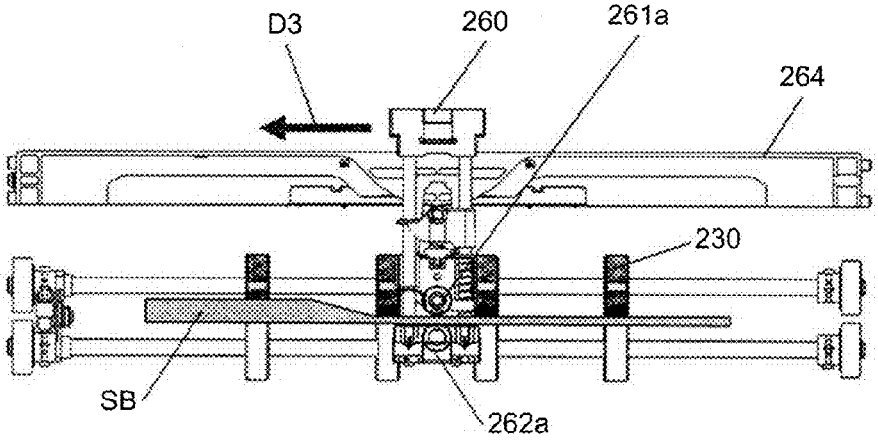
FIG. 20 is an operation explanatory diagram that illustrates a state where the fold-enhancing roller unit reaches the sixth guide path so that it shifts from a de-pressurized state to a pressurized state.
Figure 21:
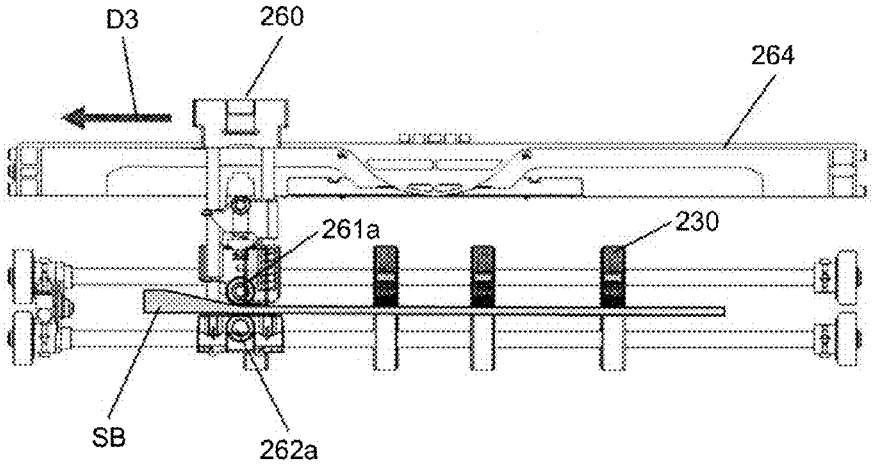
FIG. 21 is an operation explanatory diagram that illustrates a state where the fold-enhancing roller unit enters a fifth guide path so that it enters a completely pressurized state.

Next, the fold-enhancing roller unit 260 is started to move backward by the unit moving mechanism 263 (FIG. 18). During the backward movement, the pressing mechanism 265 is moved along the fourth guide path 274 to the left in the drawing (in the direction of the arrow D3). By this movement, the pressing mechanism 265 reaches the sixth guide path 276 while it is located inside the other end of the bundle of sheets SB (FIG. 19) (although it is desirably in the central portion of the bundle of sheets SB as illustrated in FIG. 19, it may be in the vicinity of the other end of the bundle of sheets SB as illustrated in FIG. 23), the guide pin 265*a* is pushed downward in accordance with the form of the sixth guide path 276 so that the de-pressurized state of the pressing mechanism 265 is changed to a pressurized state (FIG. 20).

Figure 22:
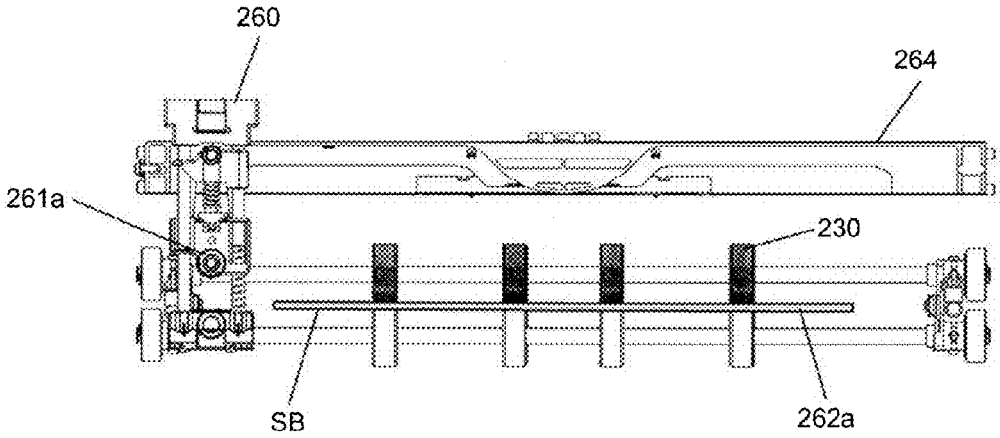
FIG. 22 is an operation explanatory diagram that illustrates a state where the fold-enhancing roller unit continuously moves along the fifth guide path and returns to the initial position.

When it then reaches the fifth guide path 275, it enters a completely pressurized state, is continuously moved in the direction of the arrow D3 along the fifth guide path 275 (FIG. 21), and is moved beyond the bundle of sheets SB (FIG. 22).

As described above, the fold-enhancing roller unit 260 is moved back and forth so that fold-enhancing is performed on the bundle of sheets SB. At that time, fold-enhancing is started at an area located inside the other end of the bundle of sheets SB (although it is desirably in the central portion of the bundle of sheets SB as illustrated in FIG. 19, it may be in the vicinity of the other end of the bundle of sheets SB as illustrated in FIG. 23) toward the one end, and it is moved beyond one end SB2 of the bundle of sheets SB. Afterward, it is moved above the bundle of fold-enhanced sheets SB, pressing is started at an area located inside (e.g., the central portion) the other end SB2*b* of the bundle of sheets toward the other end (the direction of the arrow D3), and it is moved beyond the other end SB2, whereby fold-enhancing is performed by the above operation.

By the above operation, when fold-enhancing is started, or when it is returned to the other end after it is moved beyond one end, the pair of fold-enhancing rollers 261*a* and 262*a* is not in contact with the end SB2 of the bundle of sheets SB or does not press it from the outer side of the bundle of sheets SB. Specifically, the fold-enhancing roller unit 260 is in a de-pressurized state when it passes by the end SB2 of the bundle of sheets SB from the outer side of the end. Therefore, the end SB2 of the bundle of sheets SB is not damaged. Furthermore, pressing is performed from the area located inside one end SB2*a* of the bundle of sheets SB to the other end SB2*b*; therefore, the distance it moves while it is in contact with the bundle of sheets SB during fold-enhancing becomes shorter, and accumulation of twisting, which causes wrinkles, or the like, are prevented. Thus, when fold-enhancing is performed on the fold part (spine) SB1 of the bundle of sheets SB, it is possible to prevent damages on the end SB2 of the bundle of sheets SB and to prevent the occurrence of turns and wrinkles at the fold part SB1 and in the vicinity of the fold part SB1 due to accumulation of twisting.

In order to prevent the pair of fold-enhancing rollers 261*a* and 262*a* from moving onto the end SB2 of the bundle of sheets SB from the outer side of the end SB2, an operation is performed as illustrated in FIGS. 12 to 22. Specifically, when La is a distance for which the fold-enhancing roller unit 260 moves over a bundle of sheets during a forward movement in a de-pressurized state and Lb is a distance for which it moves over a bundle of sheets during a backward movement in a de-pressurized state, it is necessary that the distances La and Lb and the length L of the bundle of sheets in a width direction are related as followings (FIGS. 12 to 14, FIGS. 17 to 19):

$$L>La+Lb$$

Furthermore, it is possible that the distance La is set to be substantially the same as the distance Lb and pressing is started in the vicinity of the central portion of the bundle of sheets SB in a width direction (FIGS. 16 and 20).

In the fold-enhancing roller unit 260 according to the present embodiment, the fold-enhancing roller/lower unit 262 is prepared so that fold-enhancing is performed by the pair of fold-enhancing rollers 261*a* and 262*a*; however, a configuration may be such that the fold-enhancing roller/lower unit 262 is eliminated and the fold-enhancing roller/upper unit 261 and an undepicted receiving member that has a contact surface that is opposed to the fold-enhancing roller/upper unit 261 are provided so that pressing is performed by them.

Furthermore, in the fold-enhancing roller unit 260 according to the present embodiment, the fold-enhancing roller/upper unit 261 is configured to be movable in a vertical direction, and the fold-enhancing roller/lower unit 262 is configured to be unmovable in a vertical direction; however, the fold-enhancing roller/lower unit 262 may be configured to be movable in a vertical direction. With such a configuration, the pair of fold-enhancing rollers 261*a* and 262*a* is operated to move close to or away from each other symmetrically with respect to the fold-enhancing position; therefore, the fold-enhancing position can be constant regardless of the thickness of the bundle of sheets SB, and damages, such as scars, can be reduced.

FIG. 23 is an explanatory diagram that illustrates various points when the fold-enhancing roller unit 260 is moved by the unit moving mechanism 263 and the state of the fold-enhancing roller unit 260 at the points. A point P1 is a standby position (initial position) after a movement is made from the HP (home position) at the left end in the drawing and before fold-enhancing on the bundle of sheets SB is started.

A point P2 is a point where the fold-enhancing roller unit 260 moves along the third guide path 273 so that the pair of fold-enhancing rollers 261*a* and 262*a* enters a pressurized state and pressing against the bundle of sheets SB is started. The point P2 is a point where the load is highest during a series of actions.

A point P3 is a point that is located at the right end of the bundle of sheets SB in the drawing and at which pressing against the bundle of sheets SB is completed during a forward movement. It is the end point of the area where the load is second highest after the point P1.

A point P4 is a point where the rotation direction of the unit moving mechanism 263 is changed so that a movement to the left in the drawing is started. At this point, the pair of fold-enhancing rollers 261*a* and 262*a* enters a de-pressurized state, and the load becomes lowest.

A point P5 is a point where the fold-enhancing roller unit 260 starts to press the bundle of sheets SB again during a backward movement. The bundle of sheets SB has been fold-enhanced already during a forward movement and the height of the bundle of sheets SB has been decreased; therefore, the load is lower than that at the point P2 during a forward movement.

Figure 24:
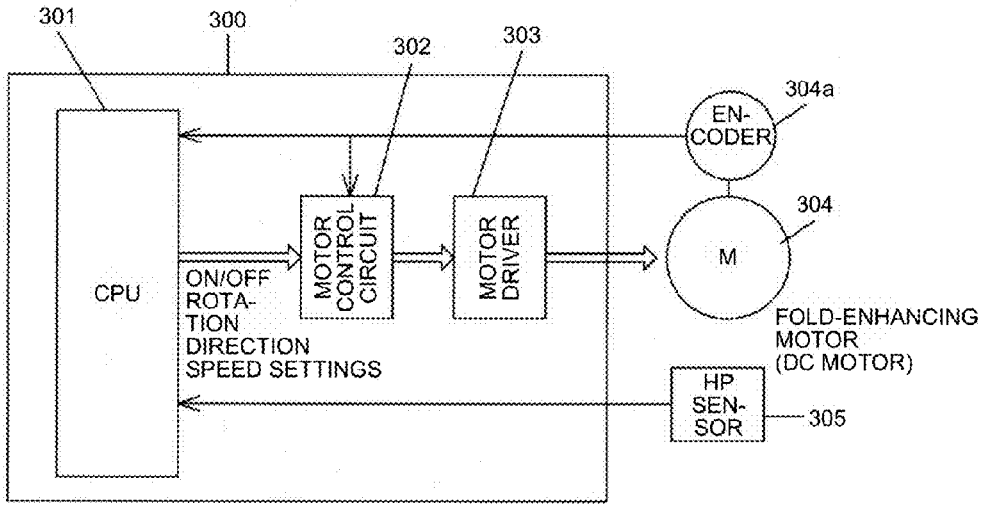
FIG. 24 is a functional block diagram that illustrates a configuration of a control board for a drive control of the fold-enhancing roller unit in the saddle-stitching binding apparatus.

FIG. 24 is a functional block diagram that illustrates a configuration of a control board (control PBC) 300 for a drive control of the fold-enhancing roller unit 260 in the saddle-stitching binding apparatus 2.

A CPU 301, a motor control circuit 302, and a motor driver 303 are mounted on the control board 300. The CPU 301 includes a one-chip CPU that performs overall control of the saddle-stitching binding apparatus 2. The CPU 301 includes a control unit and a calculation unit so that the control unit analyzes commands and controls the flow of a program control and the calculation unit performs calculations. Furthermore, a program is stored in an undepicted memory, and a command (a given value or a sequence of values) to be executed is fetched from the memory where the program is stored so that the program is executed.

A motor (a fold-enhancing motor 304) for driving the unit moving mechanism 263 includes a DC motor, and a drive control is performed via the motor control circuit 302 and the motor driver 303. Furthermore, a signal of an encoder 304*a* that is attached to a motor shaft of the fold-enhancing motor 304 is input to the CPU 301 and the motor control circuit 302.

The CPU 301 performs a servo control of the motor control circuit 302 on the basis of the rotation information on the fold-enhancing motor 304 that is input from the encoder 304*a* so that the fold-enhancing motor 304 is driven at a constant speed. Furthermore, the position of the fold-enhancing roller unit 260 is determined by counting pulses of the encoder signal. Moreover, an HP sensor (an optical sensor) 305 is provided to detect the HP (home position) of the fold-enhancing roller unit 260, and a home-position detection signal output from the HP sensor 305 is directly input to the CPU 301.

Figure 25:
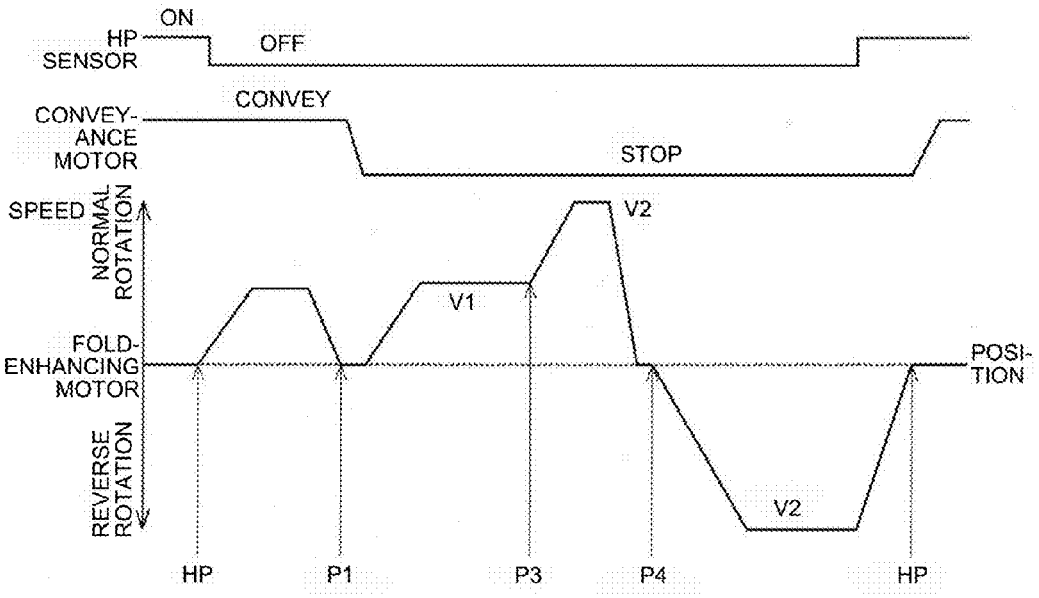
FIG. 25 is a timing chart that illustrates operation timings during a fold-enhancing operation according to the present embodiment.

FIG. 25 is a timing chart that illustrates operation timings during the fold-enhancing operation according to the present embodiment.

As illustrated in FIG. 23, the fold-enhancing roller unit 260 moves from the HP (home position) to the point P1 that is a standby position at a predetermined timing, stops at that position, and stands by. The moving speed at that time is not particularly specified. The pair of folding rollers 230 is driven by an undepicted conveyance motor so that the bundle of sheets SB that is folded in two is conveyed. When the fold part SB1 is conveyed to a position where fold-enhancing is performed by the fold-enhancing roller unit 260, it stops.

The fold-enhancing operation is started by using a rotating velocity V1 of the fold-enhancing motor 304, and the fold-enhancing roller unit 260 starts a forward movement from the point P1. By the start of movement, pressing against the bundle of sheets SB is started, and the rotating velocity of the fold-enhancing motor 304 is increased to V2 at the point P3 (at the right end position) of the bundle of sheets SB. The position of the point P3 is determined by the CPU 301 on the basis of the sheet size information that is received from the image forming apparatus PR and the count value of the encoder signal that is received from the encoder 305.

When the fold-enhancing roller unit 260 reaches the point P4 where a backward movement is started (a backward-movement start position), the fold-enhancing motor 304 is driven in reverse at the velocity V2 from the point P4. The fold-enhancing roller unit 260 moves backward at the velocity V2 while it presses the bundle of sheets SB. Then, it stops at the position where it is detected by the HP sensor 305, whereby the fold-enhancing operation is completed.

In this case, as the load is highest at the start of the first fold-enhancing, the velocity is set to V1 (a low velocity) in consideration of the torque generated by the fold-enhancing motor 304, whereby the required torque is generated. The load is lower at the area where the bundle of sheets SB is not present or at the area where pressing against the bundle of sheets SB is started during a backward movement as the bundle of sheets SB has been pressed once during a forward movement and the bundle of sheets SB has become thinner. Therefore, required torque is not as much as that required during a forward movement. Therefore, the velocity is increased to V2 so that the fold-enhancing roller unit 260 is driven at a higher velocity. Thus, the fold-enhancing roller unit 260 is driven at the velocity that matches the required torque; therefore, the time it takes for a series of operations becomes shortest, and productivity is improved. The velocities are set by using the relation of V1<V2, as described above.

Figure 26:
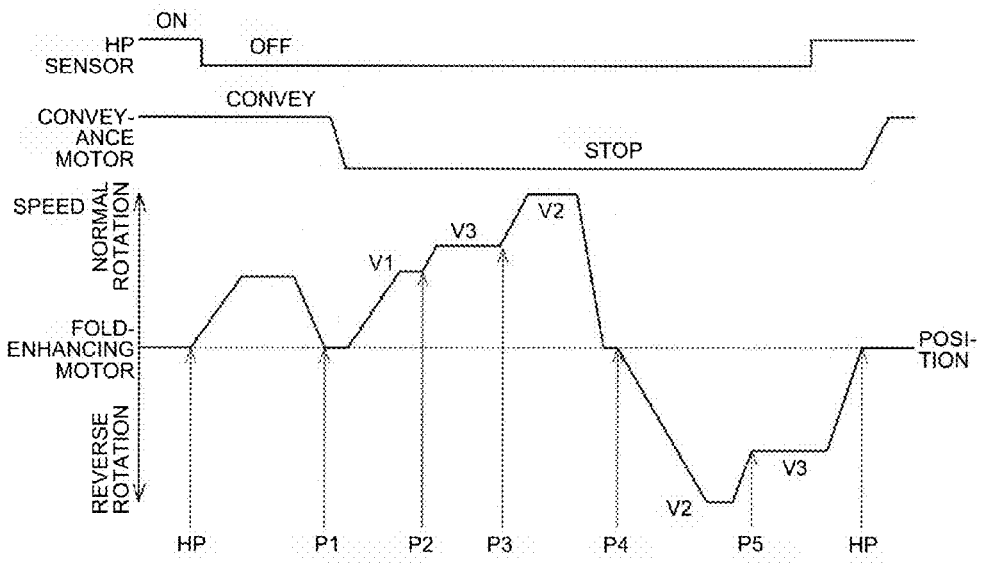
FIG. 26 is a timing chart that illustrates operation timings in a case where velocity settings are performed in a more detailed manner, compared to the velocity control illustrated in FIG. 25.

FIG. 26 is a timing chart that illustrates operation timings in a case where velocity settings are performed in a more detailed manner, compared to the velocity control illustrated in FIG. 25.

The load is highest when pressing against the bundle of sheets SB is started, and the load is lower during movement in a pressurized state of the bundle of sheets SB after the pressing is started. Furthermore, the load is lower at the area where the bundle of sheets SB is not present or at the area where pressing of the pair of fold-enhancing rollers 261*a* and 262*a* of the fold-enhancing roller unit 260 is released. Therefore, the fold-enhancing motor 304 is driven at the velocity V1 until the point P2 where the load is highest, and it is then driven at the velocity V3 that is higher than the velocity V1 but lower than the velocity V2 until the point P3 that corresponds to the end of the bundle of sheets SB.

After reaching the point P3, it is driven at the velocity V2 until the point P4 that is a backward-movement pressing start position. Then, it is controlled at the velocity V2 from the point P4 to the point P5 during a backward movement and, afterward, at the velocity V3. The relation of the velocities is V1<V3<V2. As described above, the velocities are set in a more detailed manner; thus, productivity can be further improved.

Figure 27:
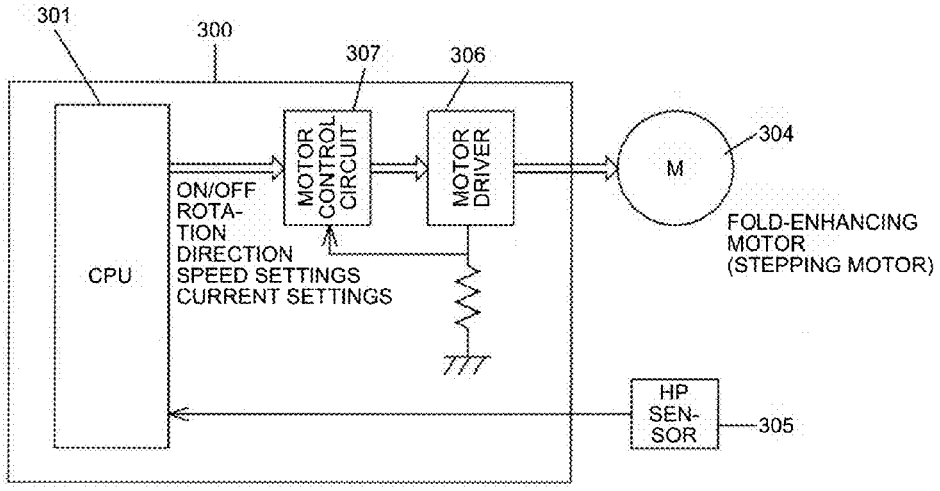
FIG. 27 is a functional block diagram that illustrates a modified example of the control board illustrated in FIG. 24.

FIG. 27 is a functional block diagram that illustrates another example (modified example) of a control configuration of the control board (the control PBC) 300 for a drive control of the fold-enhancing roller unit 260 in the saddle-stitching binding apparatus 2.

In this modified example, a stepping motor is used as the fold-enhancing motor 304. The CPU 301, a motor control circuit 307, and a motor driver 306 are mounted on the control board 300. The CPU 301 includes a one-chip CPU that performs overall control of the saddle-stitching binding apparatus 2 as in the example illustrated in FIG. 25. Driving of the fold-enhancing motor 304 (stepping motor) for driving the unit moving mechanism 263 is controlled via the motor control circuit 307 and the motor driver 306. Furthermore, a signal of an encoder 305 that is attached to a motor shaft of the fold-enhancing motor 304 is input to the CPU 301 and the motor control circuit 307.

The CPU 301 feeds back, as a signal, a current value that is supplied to the fold-enhancing motor 304 so as to perform a drive control on the fold-enhancing motor 304 with a constant current. Furthermore, the position of the fold-enhancing roller unit 260 is determined by counting motor drive clocks. The CPU 301 detects the HP (home position) that is provided for the fold-enhancing roller unit 260, on the basis of the detection signal directly input from the HP sensor 305, thereby determining the position of the fold-enhancing roller unit 260 by using the HP as a reference.

Figure 28:
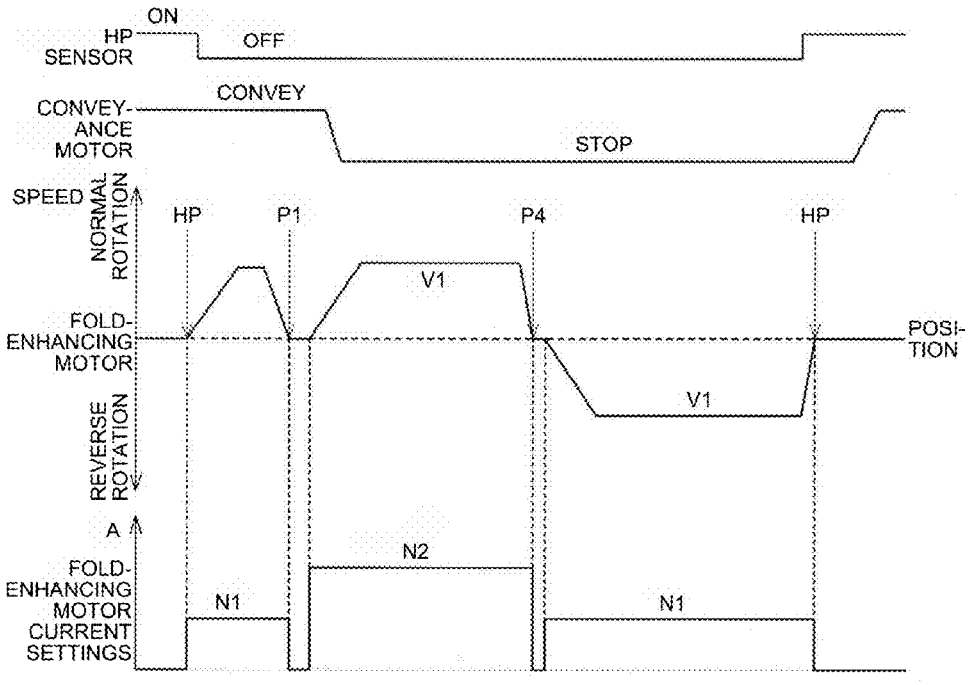
FIG. 28 is a timing chart that illustrates operation timings during a fold-enhancing operation according to the modified example illustrated in FIG. 27.

FIG. 28 is a timing chart that illustrates operation timings during a fold-enhancing operation according to the modified example.

As illustrated in FIG. 28, the fold-enhancing roller unit 260 moves from the HP to the standby position P1 at a predetermined timing and stops at that position so as to stand by. A set current N1 of the fold-enhancing motor 304 at that time is not particularly specified. The pair of folding rollers 230 is driven by an undepicted conveyance motor so that the bundle of half-folded sheets SB is conveyed. When the fold part SB1 reaches a position where fold-enhancing is performed by the fold-enhancing roller unit 260, it stops.

The fold-enhancing operation is started by using a motor set current N2 of the fold-enhancing motor 304, and the fold-enhancing roller unit 260 starts a forward movement from the standby position P1. When the fold-enhancing roller unit 260 moves forward and reaches the backward-movement start position P4 where a backward movement is started, the fold-enhancing motor 304 is driven in reverse by the motor set current N1. The fold-enhancing roller unit 260 presses the bundle of sheets SB during a backward movement and then stops at the HP that is the position where an output from the HP sensor 305 is detected. Thus, the fold-enhancing operation is completed.

At that time, as the load of a fold-enhancing operation during a forward movement is high, the motor set current N2, which is a higher current, is set in consideration of torque generated by the motor, whereby the required torque is generated. At the area where pressing against the bundle of sheets SB is started during a backward movement, the load is lower as the bundle of sheets has been pressed once during a forward movement and has become thinner; therefore, the required torque is not as much as that during a forward movement. Hence, driving is performed by using the motor set current N1 that is a lower current. Thus, as driving is performed by using the current that matches the required torque, the energy for a series of operations is optimized, and the energy saving performance is improved. The currents are set by using the relation of N1<N2, as described above.

Figure 29:
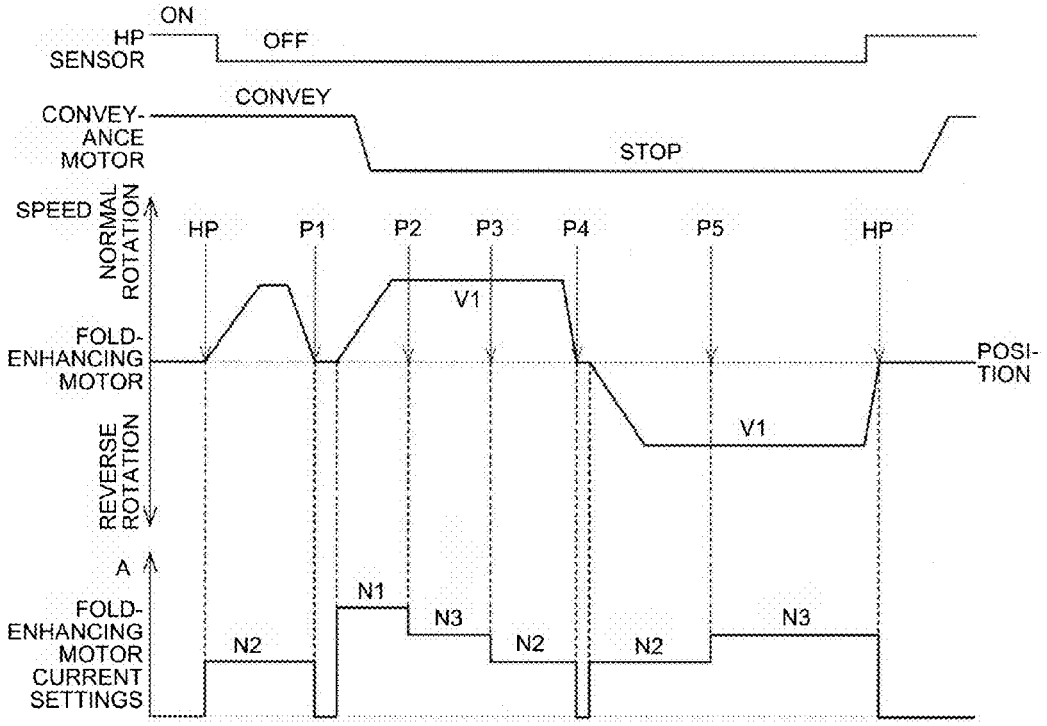
FIG. 29 is a timing chart that illustrates operation timings in a case where motor current settings are performed in a more detailed manner compared to the current control that is illustrated in FIG. 28.

FIG. 29 is a timing chart that illustrates operation timings in a case where motor current settings are performed in a more detailed manner compared to the current control that is illustrated in FIG. 28.

As in the case of the speed control, the load is highest when pressing against the bundle of sheets SB is started, and the load is lower after the pressing is started. Furthermore, the load is lower at the area where the bundle of sheets SB is not present or at the area where pressing of the pair of fold-enhancing rollers 261*a* and 262*a* of the fold-enhancing roller unit 260 is released. Therefore, the fold-enhancing motor 304 is driven by using the motor set current N1 until the point P2 where the load is highest, and it is driven by using a motor set current N3 until the point P3 (the right end position). Afterward, it is driven by using the motor set current N2 until the point P5 (the backward-movement pressing start position), and it is then driven by using the motor set current N3. The relation of the motor set currents is N2<N3<N1. As the currents are set in a more detailed manner as described above, it is possible to further improve energy saving performance.

In the example illustrated in FIGS. 12 to 22, the distance La is set to be substantially the same as the distance Lb, and pressing is started in the vicinity of the central portion of the bundle of sheets SB in a width direction (FIG. 15, FIG. 20). Conversely, it is possible to make a setting such that pressing is started at the area that is located inside and close to the end SB2 of the bundle of sheets SB in a width direction, as described above.

If the distance La is set to be substantially the same as the distance Lb to start pressing, the guide member can be configured to have a symmetrical shape. As a result, it is possible to reduce costs of manufacturing.

Figure 30A:
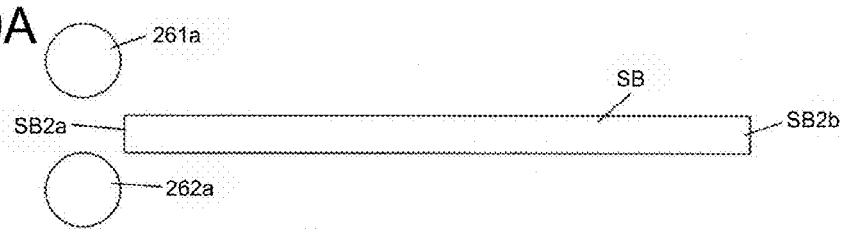
FIGS. 30A to 30G are operation explanatory diagrams that illustrate a case where pressing is started at an area located inside and close to an end of the bundle of sheets in a width direction.
Figure 30B:
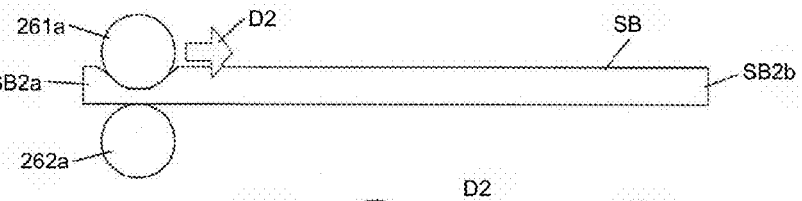
Figure 30C:
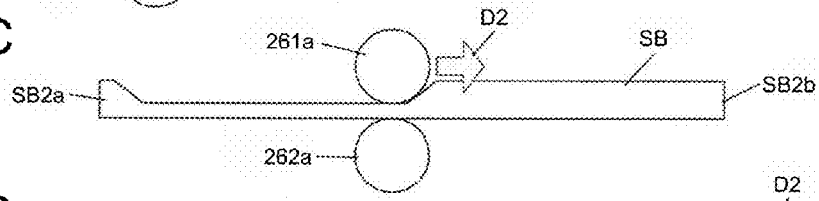
Figure 30D:
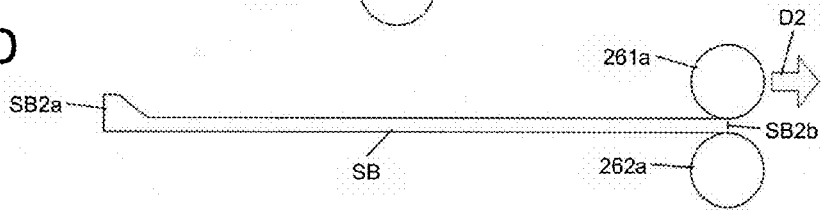

FIGS. 30A to 30G are operation explanatory diagrams that illustrate a case where pressing is started at the area that is located inside and close to the end SB2 of the bundle of sheets SB in a width direction. FIG. 30A illustrates the initial position in a case where pressing is started at the area located inside and close to the one end SB2*a*. The fold-enhancing roller unit 260 is caused to start a forward movement from the initial position (FIG. 30A) to the right in the drawing (the direction of the arrow D2) by the unit moving mechanism 263 and, when it moves to an area located slightly inside the one end SB2*a*, it shifts from a de-pressurized state to a pressurized state (FIG. 30B). Fold-enhancing is started in this state while a movement is made in the direction of the arrow D2, and the fold-enhancing roller unit 260 is moved toward the other end SB2*b* as illustrated in FIG. 30C.

Figure 30E:
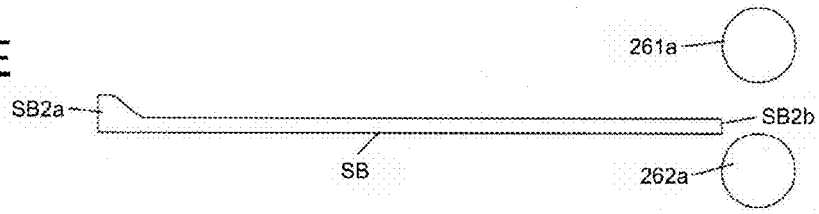

The fold-enhancing roller unit 260 is further moved in the direction of the arrow D2 in the pressurized state and, after fold-enhancing is performed on the other end SB2*b* (FIG. 30D), it is moved beyond the other end SB2*b*. When it is moved beyond the other end SB2*b*, the pair of fold-enhancing rollers 261*a* and 262*a* enters a de-pressurized state (FIG. 30E).

Figure 30F:
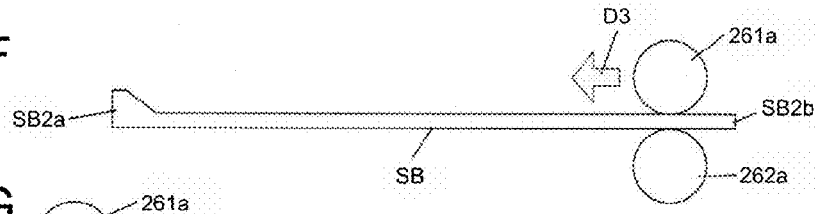
Figure 30G:
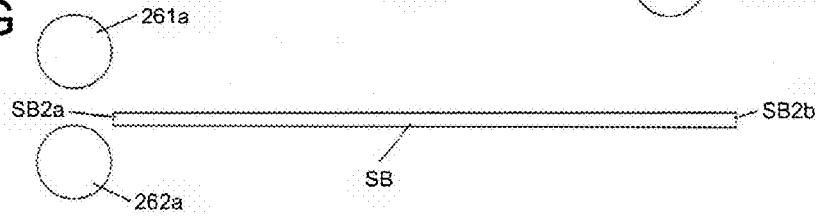

Then, the fold-enhancing roller unit 260 is caused to start a backward movement by the unit moving mechanism 263 (FIG. 30F). During a backward movement, the pressing mechanism 265 is moved in the direction of the arrow D3 together with the fold-enhancing roller unit 260. By this movement, the pressing mechanism 265 shifts from the de-pressurized state to the pressurized state at an area located slightly inside the other end SB2*b* of the bundle of sheets SB, whereby pressing against the bundle of sheets SB is started. At that time, the edge of the other end SB2*b* is not in a direct contact with the pair of fold-enhancing rollers 261*a* and 262*a*. Then, it is continuously moved in the direction of the arrow D3 in the pressurized state and is moved beyond the one end SB2*a* of the bundle of sheets SB (FIG. 30G).

A de-pressurized state and a pressurized state are set as described above; therefore, pressing against the bundle of sheets SB is started at an area located inside the one end SB2*a* or the other end SB2*b*, and the pair of fold-enhancing rollers 261*a* and 262*a* are not in a direct contact with the edge of each of the ends SB2*a* and SB2*b*. The mechanism that operates as illustrated in FIGS. 30A to 30G is the same as that illustrated in FIGS. 9, 10, and 11, and only the settings of the distances La and Lb are different.

Furthermore, in the above-described embodiment, fold-enhancing is performed by moving the fold-enhancing roller unit 260 while the bundle of sheets SB is kept stationary, but the relationship between the both are relative. Therefore, a configuration may be such that the fold-enhancing roller unit

Figure 31A:
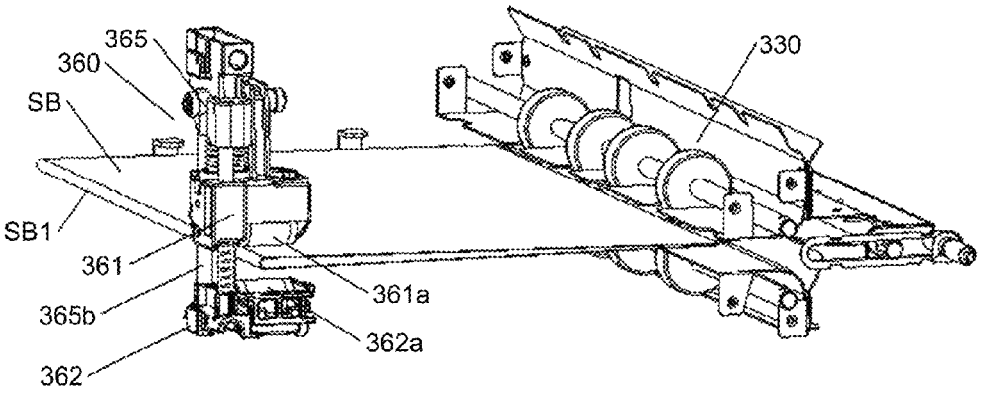
FIGS. 31A to 31C are operation explanatory diagrams that illustrate a case where fold-enhancing is performed while the fold-enhancing roller unit is kept stationary along the direction of a sheet fold.
Figure 31B:
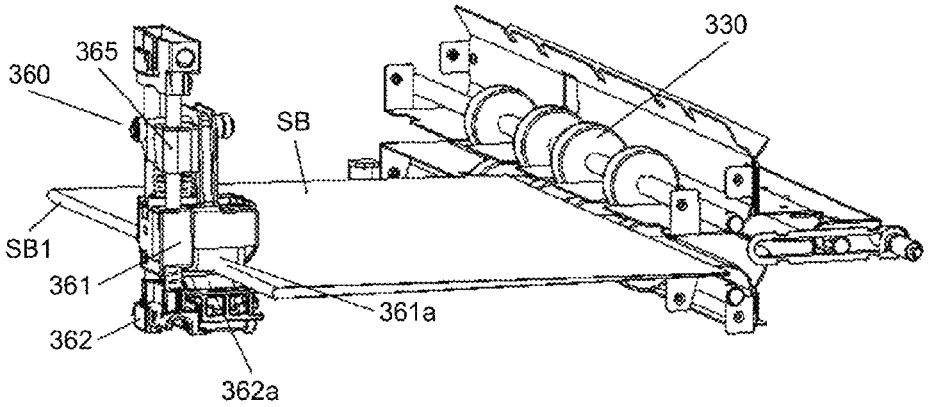
Figure 31C:
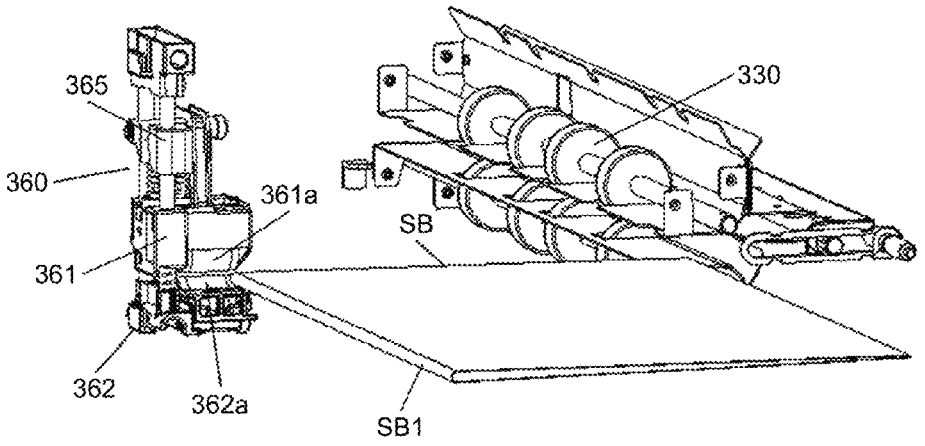

260 is kept stationary along the direction of a sheet fold and the pair of fold-enhancing rollers 261*a* and 262*a* is rotated while pressing the fold part SB1 of the bundle of sheets SB. FIGS. 31A to 31C illustrate this example.

FIGS. 31A to 31C are operation explanatory diagrams that illustrate a case where fold-enhancing is performed in a state where the fold-enhancing roller unit 260 is kept stationary along the direction of a sheet fold.

In this example, as illustrated in FIGS. 31A to 31C, the bundle of sheets SB is conveyed by a pair of folding rollers 330 and is delivered to a fold-enhancing roller unit 360 by an undepicted sheet-bundle conveyance member. The bundle of sheets SB is received in a state where an upper fold-enhancing roller 361*a* is located apart from a lower fold-enhancing roller 362*a* (in a de-pressurized state) (FIG. 31A). Afterward, the upper fold-enhancing roller 361*a* and the lower fold-enhancing roller 362*a* shift to a pressurized state (FIG. 31B). Then, the pair of fold-enhancing rollers 261*a* and 262*a* is driven so as to rotate along the direction of the fold in the pressurized state. Thus, the bundle of sheets SB is conveyed in the direction of the fold (FIG. 31C), and fold-enhancing is performed on the fold part SB1 during this process.

In FIGS. 31A to 31C, the reference numeral 365 denotes a pressing mechanism, the reference numeral 361 denotes a fold-enhancing roller/upper unit, the reference numeral 362 denotes a fold-enhancing roller/lower unit, and the reference numeral 365*b* denotes a support member, and they have the same functionality as the above-described pressing mechanism, the fold-enhancing roller/upper unit, the fold-enhancing roller/lower unit, and the support member that are denoted by the reference numerals 265, 261, 262, and 265*b*.

As described above, according to the present embodiment, the following advantage is provided.

1) The saddle-stitching binding apparatus (the sheet processing apparatus) includes the pair of fold-enhancing rollers (pressing member) 261*a* and 262*a* that presses the fold part SB1 of the bundle of folded sheets SB so as to perform fold-enhancing; and the unit moving mechanism (moving unit) 263 that moves the pressing position of the pair of fold-enhancing rollers 261*a* and 262*a* in the direction of the fold of the bundle of sheets SB, wherein the unit moving mechanism 263 starts pressing at an area located inside the one end SB2*a* (one end) of the bundle of sheets SB while moving at the first velocity V1, and releases the pressing after passing through the other end SB2*b* (the other end) of the bundle of sheets SB during a forward movement, and starts pressing at an area located inside the other end SB2*b* of the bundle of sheets SB while moving at the second velocity V2 that is higher than the first velocity V1, and passes through the one end SB2*a* of the bundle of sheets SB during a backward movement; thus, the moving time during fold-enhancing can be shorten, and productivity can be improved (see, for example, FIG. 25).

For example, the pair of fold-enhancing rollers 261*a* and 262*a* presses the fold part SB1 at the roller nip from the area located inside the one end SB2*a* of the bundle of sheets SB during a forward movement, and it moves beyond the other end SB2*b* of the bundle of sheets SB in this state. Furthermore, in a state where the roller nip is released outside of the other end SB2*b*, it moves backward to the area located inside the other end SB2*b* of the bundle of sheets SB. Then, the pair of fold-enhancing rollers 261*a* and 262*a* presses it at the roller nip from the area located inside the other end SB2*b*, and moves beyond the one end SB2*a* of the bundle of sheets SB. As described above, the pair of fold-enhancing rollers 261*a* and 262*a* is moved back and forth with respect to the bundle of sheets SB. Thus, during a backward movement, fold-enhancing is again performed on a portion of the fold part SB1 of the bundle of sheets SB that has been fold-enhanced once during a forward movement and has become thinner; therefore, the drive load is lower. Thus, even if the velocity is increased during a backward movement, it is possible to adequately perform fold-enhancing.

2) The saddle-stitching binding apparatus 2 (the sheet processing apparatus) includes the pair of fold-enhancing rollers (the pressing member) 261*a* and 262*a* that presses the fold part SB1 of the bundle of folded sheets SB so as to perform fold-enhancing; and the unit moving mechanism (the moving unit) 263 that includes the fold-enhancing motor (the driving source) 304 that moves the pressing position of the pair of fold-enhancing rollers 261*a* and 262*a* in the direction of the fold of the bundle of sheets SB, wherein the unit moving mechanism 263 starts pressing at an area located inside the one end (one end) SB2*a* of the bundle of sheets SB while performing a movement by applying the first set current N2 to the fold-enhancing motor 304, and releases the pressing after passing through the other end (other end) SB2*b* of the bundle of sheets SB during a forward movement, and starts pressing at an area located inside the other end SB2*b* of the bundle of sheets SB while performing a movement by applying the second set current N1 that is lower than the first set current N2, and passes through the one end SB2*a* of the bundle of sheets SB during a backward movement; thus, it is possible to reduce the power consumption during fold-enhancing and improve energy saving performance.

3) A DC motor or stepping motor may be used as the driving source; therefore, it is possible to improve productivity and energy saving performance by using a simple configuration and control.

4) The guide member 264 is provided to control start and release of pressing of the fold-enhancing roller unit 260, and the fold-enhancing roller unit 260 is moved by the unit moving mechanism 263 along the guide path 270 of the guide member 264; therefore, it is possible to start pressing and release pressing during a movement.

5) The guide member 264 includes the first path switching claw 277 and the second path switching claw 278 to switch the path, and the first path switching claw 277 and the second path switching claw 278 switch the path so as to switch between pressing and release of pressing; thus, it is possible to switch an operation to start pressing and an operation to release pressing by only a movement along the path.

6) The guide path 270 includes the first to sixth guide paths 271 to 276, and the guide paths 271 to 276 serve as a cam groove; thus, it is possible to perform an operation to start and release pressing at a stable position and timing.

In the present embodiment, a bundle of sheets set forth in claims corresponds to the reference numeral SB, the fold part corresponds to the reference numeral SB1, the pressing member corresponds to the pair of fold-enhancing rollers 261*a* and 262*a*, the moving unit corresponds to the unit moving mechanism 263, the sheet processing apparatus corresponds to the saddle-stitching binding apparatus 2, the guide unit corresponds to the guide member 264, the path corresponds to the guide path 270, the switching unit corresponds to the first and second path switching claws 277 and 278, the first guide path corresponds to the reference numeral 271, the second guide path corresponds to the reference numeral 272, the third guide path corresponds to the reference numeral 273, the fourth guide path corresponds to the reference numeral 274, the fifth guide path corresponds to the reference numeral 275, the sixth guide path corresponds to the reference numeral 276, the support member corresponds to the reference numeral 265*b*, and the image forming system corresponds to the system that includes the saddle-stitching binding apparatus 2 and the image forming apparatus PR.

According to an aspect of the present invention, it is possible to shorten the moving time during fold-enhancing so as to improve productivity.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A sheet processing apparatus comprising:

a pressing member that presses a fold part of a bundle of folded sheets so as to perform fold-enhancing; and a moving unit that moves a pressing position of the pressing member in a direction of a fold of the bundle of sheets, wherein the moving unit starts pressing at an area located inside one end of the bundle of sheets while moving at a first velocity, and releases the pressing after passing through other end of the bundle of sheets during a forward movement, and starts pressing at an area located inside the other end of the bundle of sheets while moving at a second velocity that is higher than the first velocity, and passes through the one end of the bundle of sheets during a backward movement.

2. The sheet processing apparatus according to claim 1, wherein, when V1 is the first velocity at start of pressing during the forward movement, V3 is the second velocity during the backward movement, and V2 is a velocity from when a release from the bundle of sheets is made to when pressing during a backward movement is started, the velocities are related by V1<V3<V2.

3. The sheet processing apparatus according to claim 1, wherein the driving source is a DC motor.

4. The sheet processing apparatus according to claim 1, wherein the driving source is a stepping motor.

5. The sheet processing apparatus according to claim 1, comprising a guide unit that controls start and release of pressing of the pressing unit, wherein the pressing unit is moved by the moving unit along a path of the guide unit.

6. The sheet processing apparatus according to claim 5, wherein the guide unit includes a switching unit that switches the path, and the switching unit switches the path so as to switch between pressing and release of pressing.

7. The sheet processing apparatus according to claim 5, wherein the path includes:

a first guide path that guides the pressing unit in a de-pressurized state during a forward movement;

a second guide path that guides the pressing unit in a pressurized state during a forward movement;

a third guide path that switches the pressing unit from the de-pressurized state to the pressurized state during a forward movement;

a fourth guide path that guides the pressing unit in a de-pressurized state during a backward movement;

a fifth guide path that guides the pressing unit in a pressurized state during a backward movement; and a sixth guide path that switches the pressing unit from the de-pressurized state to the pressurized state during a backward movement.

8. The sheet processing apparatus according to claim 1, wherein the area located inside is located in vicinity of a central portion of the bundle of sheets or in vicinity of an end of the bundle of sheets.

9. An image forming system comprising the sheet processing apparatus according to claim 1.

10. The sheet processing apparatus of claim 1, performing a sheet-bundle fold-enhancing method, the sheet-bundle fold-enhancing method comprising:

performing a forward movement in a de-pressurized state of the pressing member by the moving unit and starting pressing at an area located inside one end of the bundle of sheets at a first velocity by using the pressing member;

performing a forward movement in a pressurized state obtained at the first step and stopping at an area where the bundle of sheets is passed;

entering a de-pressurized state after the second step and performing a backward movement to an area located inside other end of the bundle of sheets in a de-pressurized state;

starting pressing at an area located inside the other end while performing a backward movement at a second velocity that is higher than the first velocity; and performing a backward movement in a pressurized state obtained at the fourth step and stopping at an area where the bundle of sheets is passed.

11. A sheet processing apparatus comprising:

a pressing member that presses a fold part of a bundle of folded sheets so as to perform fold-enhancing; and a moving unit that includes a driving source that moves a pressing position of the pressing member in a direction of a fold of the bundle of sheets, wherein the moving unit starts pressing at an area located inside one end of the bundle of sheets while performing a movement by applying a first set current to the driving source, and releases the pressing after passing through other end of the bundle of sheets during a forward movement, and starts pressing at an area located inside the other end of the bundle of sheets while performing a movement by applying a second set current that is lower than the first set current, and passes through the one end of the bundle of sheets during a backward movement.

12. The sheet processing apparatus according to claim 11, wherein, when N1 is the first set current that is applied to the driving source at start of pressing during the forward movement, N3 is a set current during movement in a pressurized state of the bundle of sheets after pressing is started, and N2 is a set current from when a release from the bundle of sheets is made to when pressing during a backward movement is started, the set currents are related by N1>N3>N2.

13. The sheet processing apparatus according to claim 11, wherein the driving source is a DC motor.

14. The sheet processing apparatus according to claim 11, wherein the driving source is a stepping motor.

15. The sheet processing apparatus according to claim 11, comprising a guide unit that controls start and release of pressing of the pressing unit, wherein the pressing unit is moved by the moving unit along a path of the guide unit.

16. The sheet processing apparatus according to claim 15, wherein the guide unit includes a switching unit that switches the path, and the switching unit switches the path so as to switch between pressing and release of pressing.

17. The sheet processing apparatus according to claim 15, wherein the path includes:

a first guide path that guides the pressing unit in a de-pressurized state during a forward movement;

a second guide path that guides the pressing unit in a pressurized state during a forward movement;

a third guide path that switches the pressing unit from the de-pressurized state to the pressurized state during a forward movement;

a fourth guide path that guides the pressing unit in a de-pressurized state during a backward movement;

a fifth guide path that guides the pressing unit in a pressurized state during a backward movement; and a sixth guide path that switches the pressing unit from the de-pressurized state to the pressurized state during a backward movement.

18. The sheet processing apparatus according to claim 11, wherein the area located inside is located in vicinity of a central portion of the bundle of sheets or in vicinity of an end of the bundle of sheets.

19. An image forming system comprising the sheet processing apparatus according to claim 11.

20. The sheet processing apparatus of claim 11, performing a sheet-bundle fold-enhancing method, the sheet-bundle fold-enhancing method comprising:

performing a forward movement in a de-pressurized state of the pressing member by the moving unit and starting pressing at an area located inside one end of the bundle of sheets while performing a movement by applying a first set current by using the pressing member;

performing a forward movement in a pressurized state obtained at the first step and stopping at an area where the bundle of sheets is passed;

entering a de-pressurized state after the second step and performing a backward movement to an area located inside other end of the bundle of sheets in a de-pressurized state;

starting pressing at an area located inside the other end while performing a backward movement by applying a second set current that is lower than the first set current; and performing a backward movement in a pressurized state obtained at the fourth step and stopping at an area where the bundle of sheets is passed.

* * * * *